US008328412B2

(12) United States Patent
Higbee

(10) Patent No.: US 8,328,412 B2
(45) Date of Patent: Dec. 11, 2012

(54) COMBINED AXIAL-RADIAL INTAKE IMPELLER WITH CIRCULAR RAKE

(75) Inventor: Robert W. Higbee, Harrisburg, PA (US)

(73) Assignee: Philadelphia Mixing Solutions, Ltd., King of Prussia, PA (US)

( * ) Notice: Subject to any disclaimer, the term of this patent is extended or adjusted under 35 U.S.C. 154(b) by 451 days.

(21) Appl. No.: 12/488,305

(22) Filed: Jun. 19, 2009

(65) Prior Publication Data

US 2009/0314698 A1 Dec. 24, 2009

Related U.S. Application Data

(60) Provisional application No. 61/074,587, filed on Jun. 20, 2008.

(51) Int. Cl.
*B01F 7/06* (2006.01)
*B01F 7/22* (2006.01)

(52) U.S. Cl. ..... 366/270; 366/330.3; 416/238

(58) Field of Classification Search ..... 366/270, 366/330.3; 416/223 R, 238, 243, DIG. 2
See application file for complete search history.

(56) References Cited

U.S. PATENT DOCUMENTS

| | | | | |
|---|---|---|---|---|
| 384,498 | A * | 6/1888 | Bartlett | 416/238 |
| 606,384 | A * | 6/1898 | Griese | 122/411 |
| 870,136 | A | 11/1907 | Shaw | |
| 1,019,437 | A | 3/1912 | Draper | |
| 1,358,430 | A | 11/1920 | Faehrrmann | |
| 1,455,591 | A | 5/1923 | Lawson | |
| 1,543,261 | A | 6/1925 | Hickmann | |
| 1,639,785 | A | 8/1927 | Sepulveda | |
| 2,031,769 | A * | 2/1936 | Gilbert et al. | 366/201 |
| 2,047,847 | A | 7/1936 | Ambjornson | |
| 2,090,888 | A | 2/1937 | Gill | |
| 2,087,243 | A | 7/1937 | Caldwell | |
| 2,460,902 | A | 2/1949 | Odor | |
| 2,468,723 | A | 4/1949 | Barlett, Jr. | |
| 2,524,870 | A | 10/1950 | Admtchik et al. | |
| 2,667,936 | A | 2/1954 | Clark | |

(Continued)

FOREIGN PATENT DOCUMENTS

GB 339248 A 12/1930

OTHER PUBLICATIONS

International Application No. PCT/US2009/048012: International Search report dated Aug. 18, 2009, 4 pages.

*Primary Examiner* — David Sorkin
(74) *Attorney, Agent, or Firm* — Woodcock Washburn LLP

(57) ABSTRACT

An impeller, a system for mixing a fluid, and a method of mixing a fluid in a tank are disclosed. For a sufficiently small impeller diameter and maximum blade tip velocity, the disclosed impeller, system, and method are capable of accelerating a near-zero intake velocity fluid, to generate a mixing zone that is collimated enough to have sufficient velocity vectors to suspend particles at a large distance away from the impeller, while minimizing the required power draw. An impeller may include a hub defining a longitudinal axis and plural blades spaced circumferentially about the hub. Each blade may include a root portion and a tip portion. Each blade may define a leading edge having an approximately circular raked helical geometry. A system for mixing a fluid may include a tank for containing the fluid, a drive shaft for extending into the tank, and the impeller.

26 Claims, 12 Drawing Sheets

U.S. PATENT DOCUMENTS

| | | | |
|---|---|---|---|
| 3,312,286 | A | 4/1967 | Irgens |
| 3,367,423 | A | 2/1968 | VanRanst |
| 3,697,193 | A | 10/1972 | Phillips |
| 3,782,857 | A | 1/1974 | Svilans |
| 3,936,225 | A | 2/1976 | Stjernstrom |
| 3,938,463 | A | 2/1976 | Hecker et al. |
| 4,054,272 | A | 10/1977 | Cooke |
| 4,073,601 | A | 2/1978 | Kress |
| 4,080,099 | A | 3/1978 | Snyder |
| 4,135,858 | A | 1/1979 | Entat |
| 4,240,990 | A | 12/1980 | Inhofer et al. |
| 4,304,524 | A | 12/1981 | Coxon |
| 4,306,839 | A | 12/1981 | Pien |
| 4,331,429 | A | 5/1982 | Koepsel et al. |
| 4,413,796 | A | 11/1983 | Bousquet |
| 4,514,146 | A | 4/1985 | Nojiri et al. |
| 4,552,511 | A | 11/1985 | Sumigawa |
| 4,566,531 | A | 1/1986 | Stolz |
| 4,632,636 | A | 12/1986 | Smith |
| 4,741,670 | A | 5/1988 | Brandt |
| 4,774,031 | A | 9/1988 | Schurz |
| 4,775,297 | A | 10/1988 | Bernauer |
| 4,780,058 | A | 10/1988 | Phillips |
| 4,789,306 | A | 12/1988 | Vorus et al. |
| 4,802,822 | A | 2/1989 | Gilgenbach et al. |
| 4,865,520 | A | 9/1989 | Hetzel et al. |
| 4,921,404 | A | 5/1990 | Holmberg |
| 4,929,153 | A | 5/1990 | Speer |
| 4,932,908 | A | 6/1990 | Larimer et al. |
| 5,104,292 | A | 4/1992 | Koepsel |
| RE34,011 | E | 7/1992 | Brandt |
| 5,127,857 | A | 7/1992 | Gongwer |
| 5,152,934 | A | 10/1992 | Lally et al. |
| 5,209,642 | A | 5/1993 | Larimer et al. |
| 5,236,310 | A | 8/1993 | Koepsel et al. |
| 5,368,508 | A | 11/1994 | Whittington |
| 5,405,243 | A | 4/1995 | Hurley et al. |
| 5,405,275 | A | 4/1995 | Schlangen et al. |
| 5,411,422 | A | 5/1995 | Robertson |
| 5,454,639 | A | 10/1995 | Krzywdziak |
| 5,458,414 | A | 10/1995 | Crump |
| 5,632,658 | A | 5/1997 | Chen et al. |
| 5,766,047 | A | 6/1998 | Alexander, Jr. et al. |
| 5,800,223 | A | 9/1998 | Iriono et al. |
| 5,807,151 | A | 9/1998 | Sumino |
| 6,010,307 | A | 1/2000 | McCabe |
| 6,099,256 | A | 8/2000 | Silvano |
| 6,102,661 | A | 8/2000 | Robson et al. |
| 6,371,726 | B1 | 4/2002 | Jonsson et al. |
| 6,699,016 | B1 | 3/2004 | Dean |
| 7,144,222 | B2 | 12/2006 | Lanni et al. |
| 2003/0090956 | A1 | 5/2003 | Knight et al. |
| 2007/0268779 | A1 | 11/2007 | Himmelsbach |

* cited by examiner

COMBINED AXIAL-RADIAL INTAKE IMPELLER WITH CIRCULAR RAKE

CROSS-REFERENCE TO RELATED APPLICATIONS

This application claims priority to provisional U.S. patent application No. 61/074,587, filed Jun. 20, 2008, the contents of which are incorporated herein by reference in their entirety.

TECHNICAL FIELD

The present invention relates to an impeller for mixing fluids and fluids including suspended solid particles, particularly an impeller that includes blades that combine axial and radial intake fluid motion and have a circular rake.

BACKGROUND

Marine helical propellers are well known in marine-related industries. Marine helical propellers are typically designed to optimize the mechanical thrust force and generate fluid flow as an unnecessary byproduct. In industrial mixing applications, optimizing fluid flow may be one of the goals of an impeller system, and the mechanical thrust force may be an unnecessary byproduct. Therefore, an impeller that incorporates a typical marine-style helical blade design may not be designed to optimize fluid flow for mixing applications, which may limit the effectiveness of such impellers in some mixing applications.

In large oil refinery storage tanks or other large chemical storage tanks, it may be necessary to keep solid contaminant particles or other sediment suspended in the crude oil and its derivatives or other chemical or fluid, so that contaminants do not build up on the tank floor. In such tanks, one or more side-entry impellers are often used to help keep solid contaminants suspended in the crude oil and its derivatives, thereby keeping the tank floor clean.

In anaerobic digester tanks, it may be necessary to keep solid particles suspended in the fluid, in order to aid in the anaerobic digestion process. In such tanks, one or more top-entry impellers are often used to keep solid particles suspended in the fluid. Typically, a draft tube is used to allow a top-entry impeller to generate a mixing flow at the bottom of the anaerobic digester tank.

SUMMARY

An impeller, a system for mixing a fluid, and a method of mixing a fluid in a tank are disclosed. For a sufficiently small impeller diameter and maximum blade tip velocity, the disclosed impeller, system, and method are capable of accelerating a near-zero intake velocity fluid, to generate a mixing zone that is collimated enough to have sufficient velocity vectors to suspend particles at a large distance away from the impeller, while minimizing the required power draw.

An impeller may include a hub defining a longitudinal axis and plural blades spaced circumferentially about the hub. Each blade may include a root portion and a tip portion. Each blade may define a leading edge having an approximately circular raked helical geometry. A system for mixing a fluid may include a tank for containing the fluid, a drive shaft for extending into the tank, and the impeller.

The impeller or the impeller in the system for mixing a fluid may include one or more additional features. Each blade may have a variable pitch such that the root portion induces primarily axial fluid flow and the tip induces primarily radially inward fluid flow when the blades are rotated about the longitudinal axis. Each leading edge may define a side view shape, the side view shape being tuned to approximately the same side view shape as the constant velocity fluid boundary on the intake side of the impeller. Each blade may include a pitch face that defines a plurality of camber lines, each camber line having a shape that approximately follows an exponential curve. The exponential curve for each pitch face camber line may be created within a conical helix reference frame normal to the leading edge. Each leading edge may define a top view shape, the top view shape being a circular arc of between 120 and 180 degrees. The impeller may further include a hub shell having a substantially ellipsoidal shape that has a substantially continuously varying slope in the direction of the fluid flow that is induced when the blades are rotated about the longitudinal axis. The hub may have a vertical height and the root portion of each blade may have a vertical height, and the vertical height of each root edge may be greater than the vertical height of the hub.

A method of mixing a fluid in a tank may include the steps of submerging an impeller in the tank of fluid and rotating the impeller. In the step of submerging an impeller in the tank of fluid, the impeller may include a hub defining a longitudinal axis and plural blades spaced circumferentially about the hub, each blade including a root portion and a tip portion and having a variable pitch, each blade defining a leading edge having an approximately circular raked helical geometry. The step of rotating the impeller may include rotating the impeller to pump the fluid primarily axially at the root portions of the blades and to pump the fluid radially inwardly and axially at the tip portions of the blades to produce generally collimated flow.

The method of mixing a fluid in a tank may further include the steps of disposing the impeller at a first angular orientation to produce a first collimated fluid mixing zone in a first portion of the tank and swiveling the impeller to a second angular orientation to produce a second collimated fluid mixing zone in a second portion of the tank. The step of submerging an impeller may include submerging plural impellers. The fluid may have a near-zero intake velocity. The tank may be an oil refinery storage tank, the step of submerging an impeller may include submerging an impeller near a first side of the tank, and the step of rotating the impeller may include producing generally collimated flow that extends to a second side of the tank opposite the first side of the tank. The tank may be an anaerobic digestion tank, the step of submerging an impeller may include submerging an impeller near a top surface of the fluid, and the step of rotating the impeller may include producing generally collimated flow that extends to a bottom of the tank without the use of a draft tube.

DETAILED DESCRIPTION OF ILLUSTRATIVE EMBODIMENTS

Figure 1A:
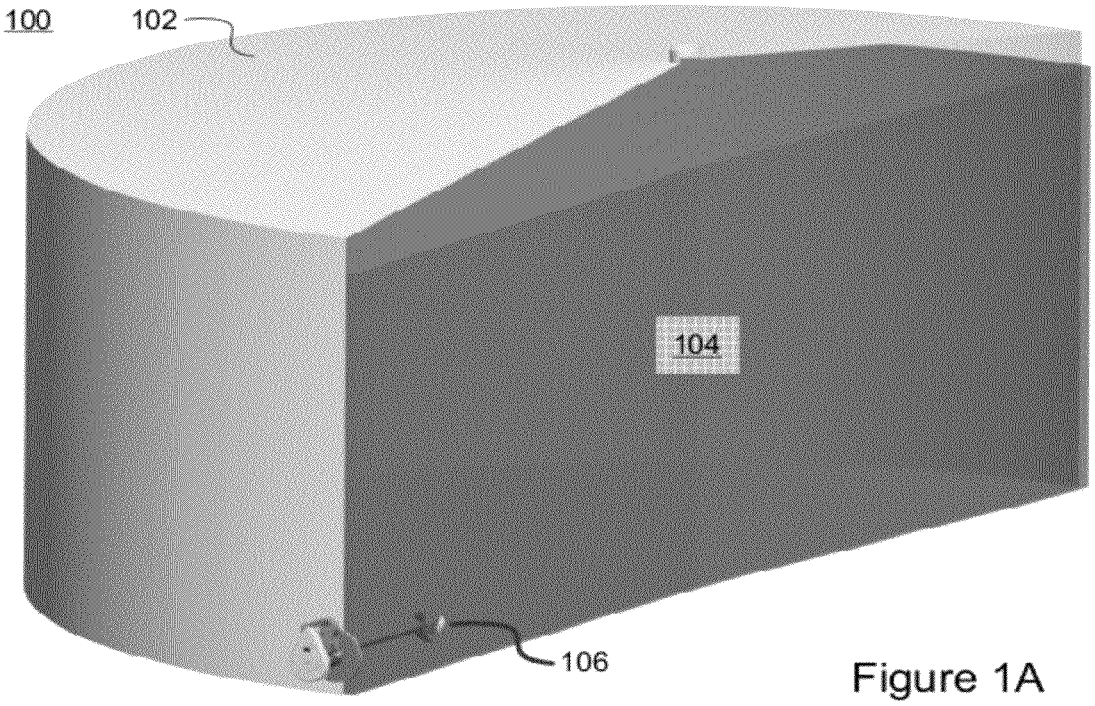
FIG. 1A is a perspective view of a side-entry impeller system according to an aspect of the invention installed in an oil refinery storage tank.

Referring to FIG. 1A, an oil refinery storage tank environment 100 includes a tank 102, a liquid 104, and a side-entry impeller 106. In a tank floor cleaning application such as an oil refinery storage tank environment 100, it may be desirable to limit the outer diameter of a side-entry impeller 106 that is used to prevent contaminant build-up on the tank floor. This diameter limitation may arise from two factors. First, in a typical oil refinery storage tank, the tank roof or lid may float on top of the crude oil and its derivatives, in order to limit the volume of air inside the tank. If the diameter of a side-entry impeller is too large, the tank roof or lid will not be able to move very close to the tank floor (it will always be at least one impeller diameter away from the tank floor, but more typically, the roof must remain at least 2.5 impeller diameters above the impeller center line), which may result in a substantial volume of crude oil and its derivatives being inaccessible and required to remain in the storage tank. Second, in a typical oil refinery storage tank, the inner diameter of the manhole, upon which a side-entry mixer may be connected, may be smaller than the diameter of the impeller used to prevent contaminant build-up on the tank floor. If the tank floor-cleaning impeller is too large to fit through the side-entry manhole opening, it may be costly and hazardous to hoist the impeller over the side of the storage tank (e.g., 75 feet high) and lower it to the bottom of the tank (where an employee may be unable to breathe due to fumes) for attachment to a motor through the side-entry opening. As used herein, a side-entry impeller in an oil refinery storage tank application penetrates into the liquid in the tank to a distance that is close to the sidewall of the tank (e.g., within 2-5 impeller diameters of the sidewall of the tank).

When cleaning the floor of a large oil refinery storage tank, it may be necessary to suspend contaminant particles at large distances from the side-entry impeller (e.g., 200 feet). Considering that it may be desirable to limit the diameter of a side-entry impeller that is used to keep the tank floor clean, many typical smaller-diameter impellers may not be able to generate enough fluid velocity, at distances far from the impeller (e.g., near the far tank wall), to keep solid contaminants of a specified particle size suspended. This may be due to the inability of many typical impellers to generate a flow that is collimated enough to allow the mixing zone (with sufficient fluid velocity to suspend contaminants) to extend from the impeller all the way to the tank wall opposite the impeller. Even if a single swiveling impeller or several stationary impellers positioned at different angles are used to clean larger portions of a tank floor, it may be necessary that the collimated mixing zone produced by each impeller extends far enough to reach the far tank wall.

Figure 1B:
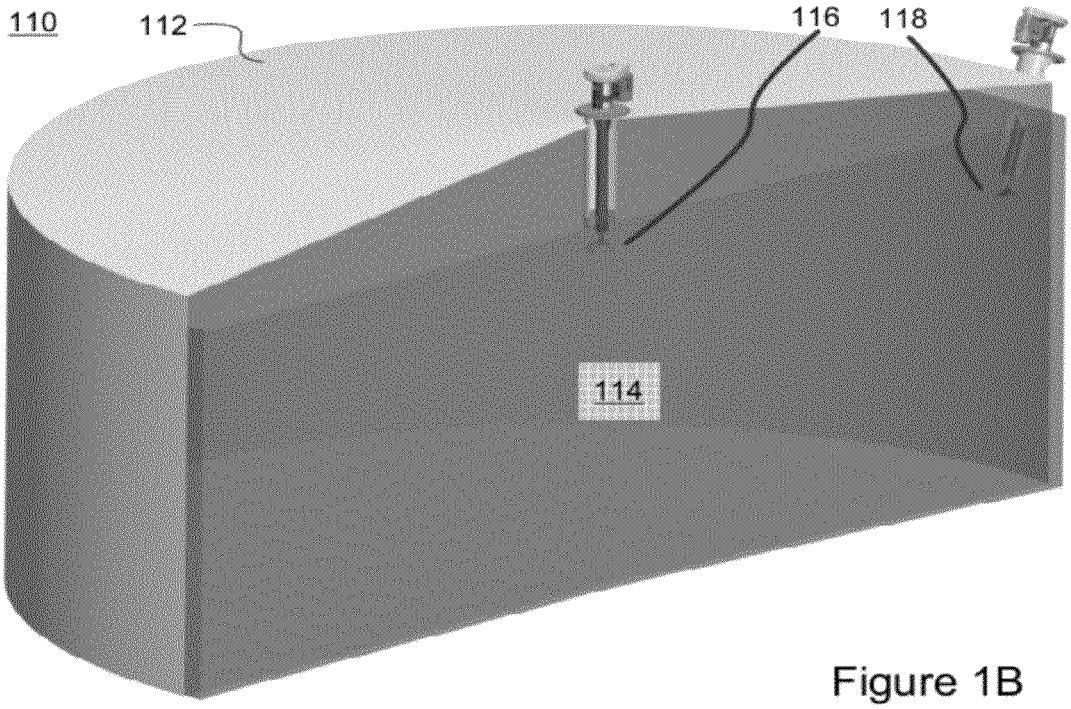
FIG. 1B is a perspective view of two embodiments of a top-entry impeller systems installed in a anaerobic digester tank.

Referring to FIG. 1B, an anaerobic digester tank environment 110 includes a tank 112, a liquid 114, and either or both of a center top-entry impeller 116 and a side top-entry impeller 118. In an anaerobic digester application, including, for example, "pancake" style anaerobic digesters, it may be necessary to suspend solid particles at large distances from the top-entry impeller 116 or 118 (e.g., 18-35 feet), in a vessel having a diameter, for example, of 40-90 feet. The digester tank 112 may have either a fixed lid or a floating lid, and the digester tank may have a conical bottom. In an anaerobic digester application, one or more impellers (each impeller using 5-20 horsepower of energy input) may be used in a single digester tank. For example, six or more impellers may be installed in a single large digester. Many typical smaller-diameter top-entry impellers may not be able to generate enough fluid velocity, at distances far from the impeller (e.g., near the tank bottom), to keep solid particles of a specified size suspended. As used herein, the terms "fluid" and "liquid" are used interchangeably, and both terms refer to a liquid, a slurry, a liquid with suspended solid particles, or a liquid with entrained gas.

In a typical anaerobic digester application, a draft tube is required to allow a top-entry impeller to generate a mixing flow at the bottom of the anaerobic digester tank that is sufficient to keep the solid particles suspended in the liquid. As used herein, a top-entry impeller in an anaerobic digester application is submerged in a liquid in the anaerobic digester tank to a depth that is close to the top surface of the liquid (e.g., within 2-5 impeller diameters of the top surface of the liquid). The required inclusion of a draft tube may be due to the inability of many typical impellers to generate a flow that is collimated enough to allow the mixing zone (with sufficient fluid velocity to suspend solid particles) to extend from the impeller all the way to the tank bottom opposite the impeller. The inclusion of a draft tube surrounding the impeller may create friction between the moving liquid and the draft tube, which may require additional energy input to compensate for the frictional forces. Also, the presence of the draft tube in the liquid may hinder the development of secondary flow characteristics that may make the mixing of the fluid more energy efficient. It may be desirable, for example, to design the shape of the impeller such that it can create a liquid flow sufficient to keep solid particles suspended that extends from the impeller to the bottom of the tank, which may eliminate the need for including a draft tube.

In some mixing applications, a higher impeller rotational velocity may be used to extend the distance covered by a mixing zone, or to increase torque per unit volume. However, it is often undesirable if the linear velocity of the blade tip exceeds a required level. Therefore, in addition to keeping the impeller diameter below an acceptable boundary, it is also desirable to keep the linear velocity of the impeller blade tips below an acceptable boundary. For example, in crude oil storage tanks with floating roofs, excessive tip speed may increase the fluid shear force acting on the roof when the fluid level is low. This may necessitate a larger minimum vertical clearance between the impeller blades and the tank roof. Also, excessive tip speed may increase undesirable vibration levels, which may reduce the life of the mixer components and further increase the fluid shear force acting on the roof when the fluid level is low. Excessive tip speed may cause cavitation, which is correlated to blade erosion. In a flue gas desulphurization application, an abrasive gypsum and limestone slurry is mixed, and excessive tip speed correlates to excessive wear of the impeller blade tips. Furthermore, mixing motors typically have commonly available drive speeds, so a need for increased impeller rotational speed may increase the cost of the mixing system.

In addition to the other desired impeller qualities, it may be desirable to create as power-efficient an impeller as possible for a given maximum impeller diameter and mixing zone. The leading edge of an impeller incorporating a typical marine-style helical blade design may not be optimally shaped to allow for highly efficient acceleration of a fluid from near-zero velocities on the inlet side of the impeller. This inefficiency may result in a higher power draw requirement to rotate the impeller than if an impeller incorporating a more optimal leading edge shape was used. It may be desirable, for example, to design the shape of the impeller leading edge such that it conforms to regions of constant fluid velocity from the leading edge root (near the hub) to the leading edge tip.

Figure 2A:
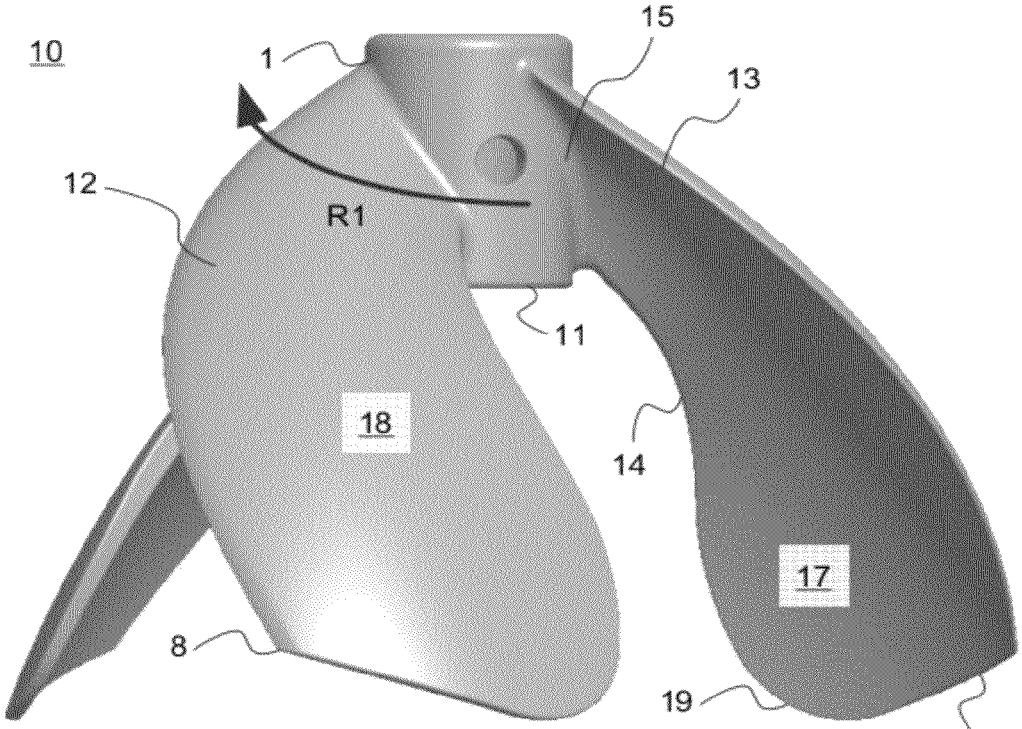
FIG. 2A is a side view of an impeller according to an aspect of the invention.
Figure 2B:
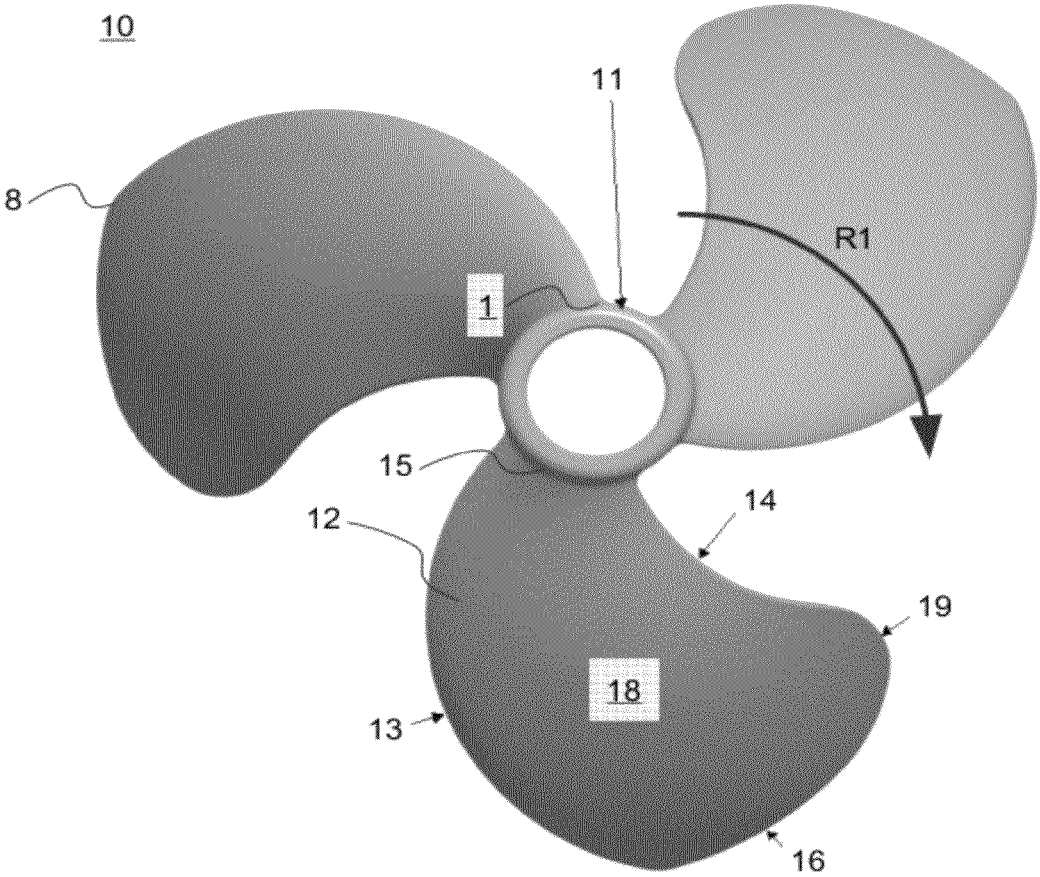
FIG. 2B is a top view of the impeller depicted in FIG. 2A.

Referring to FIGS. 2A and 2B to illustrate a preferred structure and function of the present invention, an impeller 10 includes a hub 11 and plural blades 12. Impeller 10 preferably rotates about the hub 11 in a rotational direction R1. Each blade 12 is spaced circumferentially about the hub 11, and each blade 12 includes a leading edge 13, a trailing edge 14, a root edge 15, a tip edge 16, a pitch face 17, a non-pitch face 18, and a trailing edge tip 19. The impeller 10 is preferably attached via the hub 11 to a drive shaft (not shown) for extending into a tank containing fluid. The hub 11 is preferably attached to the drive shaft via a keyway, but any other known mechanism may be used, including a spline, set screws, welding, or chemical bonding. Each blade 12 may be integrally formed to the hub 11 in a single casting, but the blades 12 may also be attached to the hub 11 by any other known mechanism, including bolting, clamping, welding, or chemical bonding.

Figure 8A:
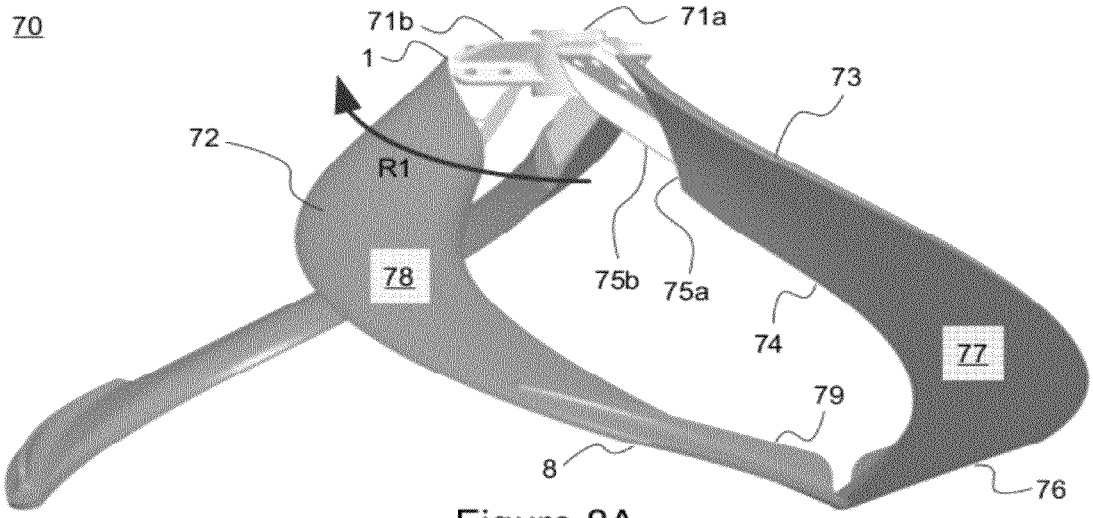
FIG. 8A is a side view of an impeller having a hyper-skewed top view profile.
Figure 8B:
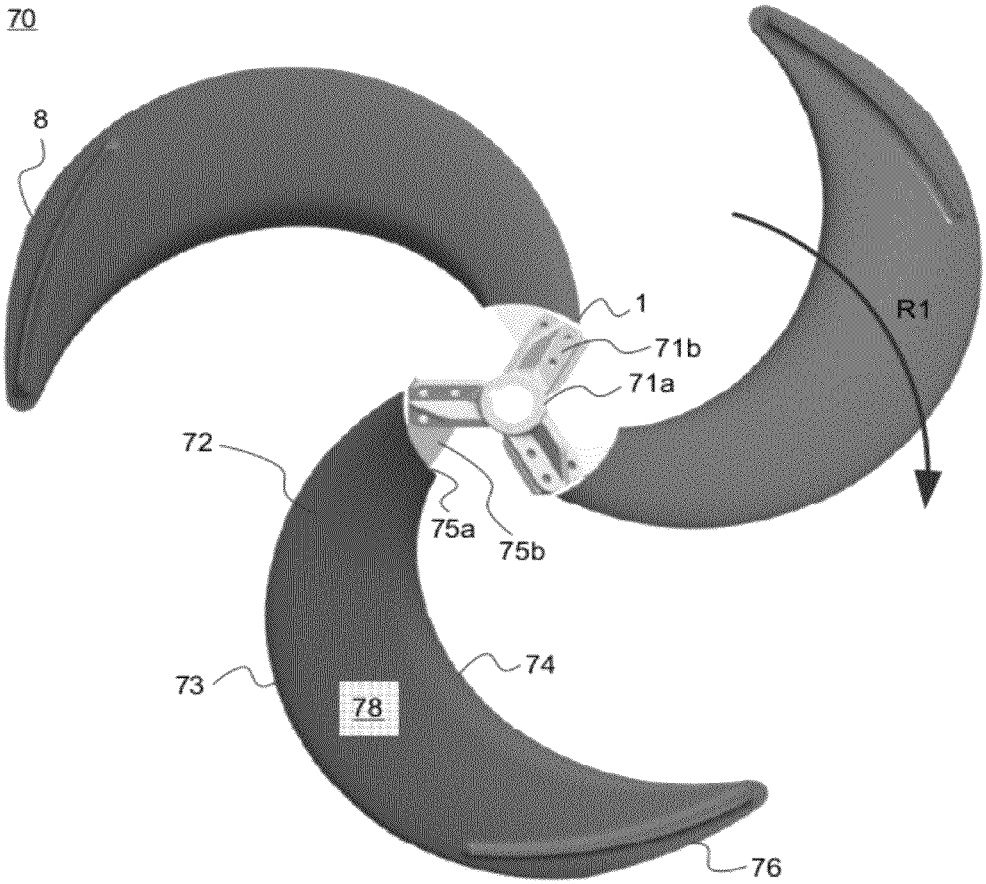
FIG. 8B is a top view of the impeller depicted in FIG. 8A.

Impeller 10 or any of the impellers as disclosed herein may be made of stainless steel, cast iron, fiberglass reinforced plastic (FRP), or any other material or combination of materials known in the art that has the strength, durability, and corrosion resistance that is required for the particular fluid that is intended to be mixed. The FRP may include, for example, a combination of woven high strength glass fiber cloth interleaved with chopped mat fiber cloth. For example, the impeller 70 that is shown in FIGS. 8A and 8B may be made of fiberglass reinforced plastic for the majority of the blade, and the impeller 70 may include a stainless steel stiffness insert 75*b* extending from the hub 71 through a portion (e.g., the radially innermost 20%) of the blades 72.

Impeller 10 or any of the impellers as disclosed herein may be mounted into the side wall, close to the bottom of a storage tank containing crude oil and its derivatives or other chemical fluids. One impeller may be used, located in a fixed rotational orientation or mounted such that it is capable of swiveling back and forth to allow a collimated mixing zone to be produced in different portions of the storage tank, depending on the rotational orientation of the impeller. Also, a plurality of stationary or swiveling impellers may be disposed at different angles relative to each other, such that the combination of impellers may be used to clean larger portions of a tank floor than a single impeller.

Impeller 10 or any of the impellers as disclosed herein may be mounted into the top or lid of a anaerobic digester tank containing liquid and suspended solid particles. One impeller may be used, located at the center or side of the top of the tank, or a plurality of impellers may be disposed at different positions and/or angles relative to each other, such that the combination of impellers may be used to suspend particles and create liquid flow in larger portions of a tank than a single impeller.

Impellers as disclosed herein may be used to mix any combination of fluids or any fluid with suspended particles, however, in a preferred embodiment, impeller 10 or any of the impellers disclosed herein is used to mix crude oil and refined oil based products in a large storage tank so that solid contaminate particles remain suspended, thereby keeping the bottom of the tank free of sediment build-up. Impeller 10 or any of the impellers disclosed herein may be used for an anaerobic digester tank. Preferably, such an oil storage tank may be approximately 200 feet in diameter, but it may also be any other size, including between approximately 100 feet and 300 feet in diameter. Preferably, such an anaerobic digester tank may be approximately 18-35 feet in diameter, but it may also be any other size, including between approximately 10 feet and 50 feet in diameter. Preferably, the impeller is between 19 and 50 inches in outer diameter, but it may also be any other diameter, including 6 inches, 8 inches, 10 inches, 12 inches, 16 inches, 19-32 inches, 24 inches, 32 inches, 36 inches, 48 inches, 50 inches, 60 inches, and 72 inches. In a preferred embodiment where a 32-inch diameter impeller is used to clean the bottom of a 200-foot diameter storage tank, there is approximately a 75:1 tank-to-impeller-diameter ratio. In other embodiments, the tank-to-diameter ratio may be any number, including ratios between 70:1 and 80:1, 60:1 and 90:1, and 10:1 and 100:1, as well as any other tank-to-diameter ratio known in the art or desired to achieve effective suspension of a particular-sized particle in a fluid of a particular chemical composition.

Preferably, impeller 10 or any of the impellers as disclosed herein has an outer diameter that is as small as possible, in order to drive tank mixing, in the embodiment of a crude oil or crude oil derivative storage tank side-entry mixer or in the embodiment of an anaerobic digester tank. In an oil tank, the roof or lid often floats on top of the crude oil and its derivatives, in order to limit the volume of air inside the tank. If the diameter of a side-entry impeller is too large, a substantial volume of crude oil and its derivatives may be inaccessible. Also, the outer diameter of the impeller is preferably smaller than the tank opening provided for side-entry impeller insertion or only slightly larger that the side-entry opening such that the impeller can be inserted through the opening. This may avoid the costly and hazardous insertion of the impeller into the tank by hoisting the impeller over the top of the tank and lowering it down into position near the tank floor.

In an embodiment of cleaning the floor of a large oil refinery storage tank, or in an embodiment of an anaerobic digester tank, it may be advantageous to suspend contaminant particles at large distances from the impeller (e.g., up to 200 feet). To enable the mixing zone produced by the impeller to extend at least 200 feet from the impeller, using an impeller 10 or any of the impellers as disclosed herein that is approximately 32 inches in diameter, for example, the impeller may produce a relatively collimated flow. The relatively collimated flow produced by the impeller does not need to be perfectly collimated, such as may be accomplished by a laser beam. In the embodiments of the impellers disclosed herein, when a flow is referred to as collimated, it means that the mixing zone that exits the volume contained within the interior of the impeller extends axially across a fluid to a distance that is at least several times the outer diameter of the impeller. Preferably, the impeller produces a mixing zone that is sufficiently collimated that the mixing zone extends 200 feet away from the impeller in an oil tank application or 35 feet away from the impeller in an anaerobic digester application, and the mixing zone contains fluid with high enough velocities to keep contaminate particles suspended in the fluid.

Also, in addition to keeping the impeller outer diameter below an acceptable boundary to fit into a tank side-entry opening, it is also desirable to keep the linear velocity of the impeller blade tips below an acceptable boundary so that the shear force exerted on the floating roof does not exceed the maximum permitted level. Also, it is desirable to keep the tip velocity below that which would promote undesirable erosion wear in gypsum limestone slurries. Furthermore, it is desirable in some applications, such as flocculation, to limit tip speed. The maximum blade tip linear velocity allowable for minimizing storage tank floating roof shear loads, flocculation, and gypsum limestone slurries without unacceptable consequences is well known to those in the art.

In order for the impeller 10 to produce a mixing zone that is sufficiently collimated and efficient for a given diameter impeller 10, such that the mixing zone reaches a tank wall 200 feet away, the geometry of the pitch faces 17 of the blades 12 of the impeller 10 are designed to produce primarily axial flow at the root edges 15 of the blades 12 and to produce primarily radial flow at the tip edges 16 of the blades 12. Of course, in the description of the embodiments herein, when a flow is described as axial, it is intended to mean primarily axial, and when a flow is described as radial, it is intended to mean primarily radial.

Given the complexity of fluid flows in many environments, the fluid flow in and around the blades 12 of the impeller 10 at all portions of the impeller 10 may include velocity vectors in both axial and radial directions simultaneously. However, the impeller 10 is designed such that the portion of the blades 12 closest to the root edges 15 should preferably perform in a manner (producing primarily axial flow) somewhat resembling that of a typical axial impeller that is known in the art (e.g., a typical helical propeller), and the impeller 10 is designed such that the portion of the blades 12 closest to the tip edges 16 should preferably perform in a manner (producing primarily inward radial flow) somewhat resembling that of a typical radial impeller that is known in the art (e.g., a squirrel cage radial fan). The blades 12 preferably accomplish primarily axial flow at the root edges 15 and primarily radial flow at the tip edges 16, preferably, by defining a smoothly varying pitch face 17 that transitions between the axial flow portion of the blades 12 and the radial flow portion of the blades 12. As used herein, the axial and/or radial fluid flow at the portion of the blades 12 closest to the root edges 15 or the tip edges 16 is describing the fluid flow vector components immediately radially outside of the blades 12, relative to the axis of rotation of the impeller, near the portion of the blades 12 closest to the root edges 15 or the tip edges 16.

In order to enhance the power efficiency of the impeller 10, the impeller 10 preferably approximately matches the geometry of the leading edge 13 to the constant-velocity profile of the fluid on the intake side, for the case of near-zero velocity reservoirs, which is the side of the non-pitch faces 18 of the blades 12 of the impeller 10. In the embodiment of mixing crude oil and its derivatives in an oil storage tank, or in the embodiment of mixing liquid in an anaerobic digester tank, the fluid on the intake side of the impeller 10 has a near-zero velocity at a relatively small distance from the intake side of the impeller 10. At points very close to the intake side of the impeller 10, once the impeller 10 begins rotating in a direction R1, there is a non-zero velocity zone on the intake side. The inventor has experimentally noted that in an oil storage tank environment or in an anaerobic digester tank environment, when using a typical helical impeller design, the approximate geometric boundary at which the fluid transitions from a near-zero velocity to a significantly non-zero velocity takes a hemispherical shape, which is a velocity profile shape that may also be typical of many other types of existing impellers. Therefore, the inventor surmises that an impeller 10 that has leading edges 13 of the blades 12 that approximately passes through space in the shape of a hemisphere as it rotates (in any given two-dimensional plane that passes through the axis rotation of the impeller 10, this shape will be approximately a circular arc) will be a, possibly the most, power-efficient design for this intended near-zero velocity sump or reservoir. Used herein, sump or reservoir means the intake side fluid source. The detailed shape of the leading edges 13 of the blades 12 of the impeller 10 can be seen and understood by reference to FIGS. 3A through 3C and the accompanying text below.

Figure 3A:
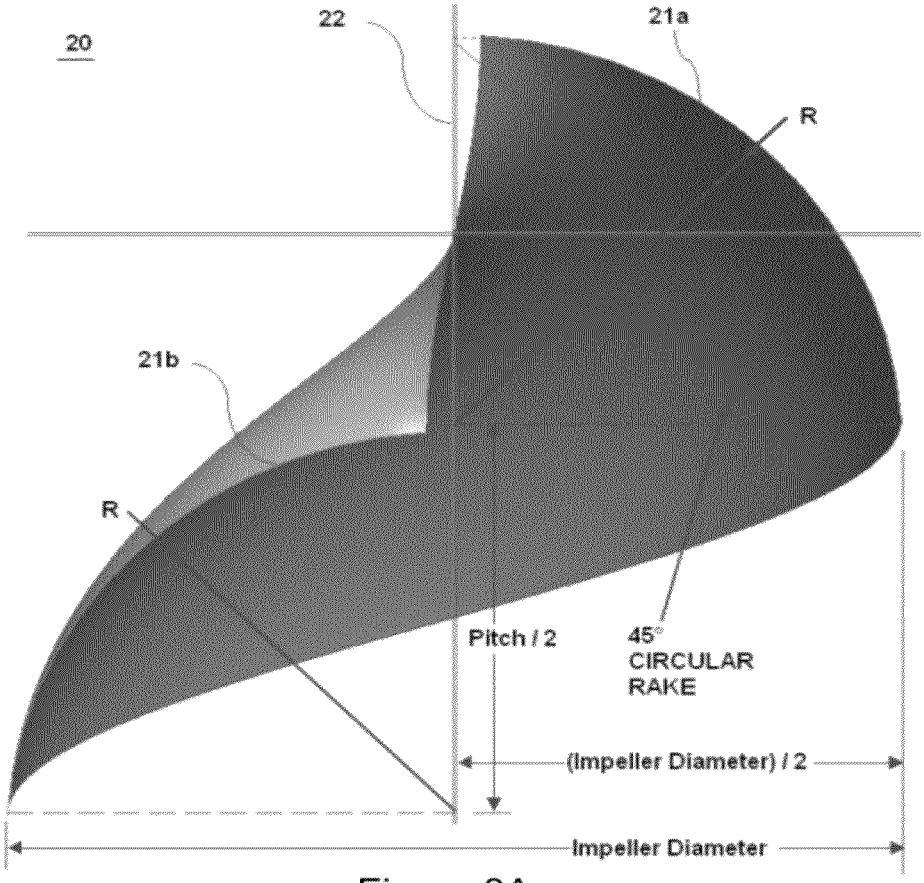
FIG. 3A is a side view of a first circular raked helix that may define the surface on which the leading edge of an impeller blade according to an aspect of the invention is located.

FIG. 3A is a side view of a first circular raked helix (having a 45-degree circular rake) that may define the surface (or approximate surface) on which the leading edge of an impeller blade according to an aspect of the invention is located (or approximately located). FIG. 3D is a side view of a second circular raked helix (having a 22.5-degree circular rake) that may define the surface (or approximate surface) on which the leading edge of an impeller blade according to an aspect of the invention is located (or approximately located). FIG. 3E is a side view of a linear zero-rake helix that may define the surface (or approximate surface) on which the leading edge of an impeller blade according to an aspect of the invention is located (or approximately located). Referring to FIG. 3A, a circular raked helix 20 includes a circular arc 21 that defines a radius R and that moves from a first position 21*a* to a second position 21*b* by rotating about a rotational axis 22 in a counter-clockwise direction if viewed from a top view. In this embodiment, as the circular arc 21 moves from the first position 21*a* to the second position 21*b*, it rotates about the rotational axis 22 by half of a complete rotation (180 degrees), while moving down a distance P/2 or half of the pitch (pitch is herein defined as the vertical drop during a complete rotation about a vertical axis, as known in the art), which will be a distance equal to half of the final intended impeller diameter, also known as a pitch-to-diameter ratio (PDR) of 1.0. In other embodiments, other PDRs may be used.

Figure 3B:
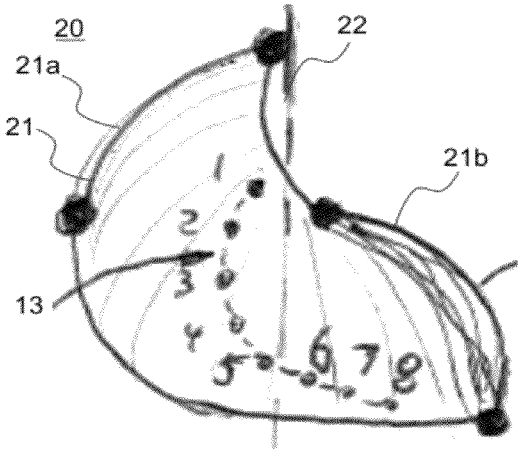
FIG. 3B is a diagrammatic perspective view of the circular raked helix depicted in FIG. 3A.

FIG. 3B is a diagrammatic perspective view of the circular raked helix depicted in FIG. 3A. As can be seen in FIG. 3B, the leading edge 13 of each blade 12 is geometrically defined (or approximately geometrically defined) relative to the rotational axis 22 by projecting a curve onto the surface of the circular raked helix 20. When viewed from a top view, the leading edge 13 will take the shape that is seen in FIG. 2B. In FIG. 2B, the leading edge 13 is shown as an arc of a circle that would go through the rotational axis (not shown in FIG. 2B) if it were extended beyond the root edge 15 of the blade 12. Although the leading edge 13 from a top view has a circular arc shape in this embodiment, in other embodiments the leading edge 13 may have other top view shapes, such as an elliptical arc, a parabolic arc, an exponential arc, or any other smoothly varying shape or a combination of smoothly varying shapes. Also as can be seen in FIG. 2B, the leading edge 13 may define approximately a ninety-degree arc, starting from the rotational axis 22 and continuing to the point 8 where the leading edge 13 meets the tip edge 16. The arc length that defines the leading edge 13 may define any portion of a circular arc, for example, it may define a 30-degree arc, a 45-degree arc, a 60-degree arc, a 75-degree arc, a 120-degree arc, a 150-degree arc, a 165-degree arc, a 180-degree arc, or any other arc portion or non-circular arc portion.

Having each blade 12 include a leading edge 13 that defines an arc shape when viewed from above (e.g., shown in FIG. 2B) means that the leading edge 13 is skewed. As used herein, a skewed leading edge profile is one that has a non-linear top-view shape. In contrast, a leading edge profile that is non-skewed would have a linear top-view shape (not shown in the figures). The impellers disclosed herein are shown to have a skewed leading edge profile, such that the leading edge has a back-swept top-view profile. As used herein, a leading edge having a back-swept top-view profile means that when the impeller is rotated in the R1 direction, the portion of the leading edge that passes through a fixed plane extending through the hub and perpendicular to the top-view leading edge starts at point 1 near the hub and progresses (as the impeller rotates) towards point 8 near the tip edge. For embodiments such as that shown in FIGS. 2A and 2B, the degree of skew may depend on the length of the arc that defines the top-view of the leading edge 13. For example, a leading edge 13 that defines a 45-degree arc from a top view will be less skewed than a leading edge 13 that defines a 90-degree arc from a top view. The present invention contemplates a leading edge having any degree of skew, including a leading edge profile that is non-skewed.

In the embodiments shown FIGS. 2A and 2B, for example, the intersection of the leading edge 13 with respect to the hub 11 is off-normal by twenty degrees, but in other embodiments, the leading edge 13 may intersect the hub 11 at any angle, for example, 45 degrees, 30 degrees, 15 degrees, 10 degrees, 5 degrees, or normal with respect to the hub outer diameter.

As can be seen in FIG. 3B, the leading edge 13 is defined as the projection of an arc that is circular in a plane normal to the axis of rotation 22 onto the surface of the circular raked helix. Although in this embodiment, the leading edge 13 is defined via projection of an arc or curve onto the surface of a circular raked helix (created by rotation of a circular arc 21 about an rotational axis 22), in other embodiments, the leading edge may be defined via projection of a curve onto the surface of a helix having any type of rake profile. For example, the leading edge may be defined via projection of a curve onto the surface of a parabolic raked helix (rotation of a parabolic arc 21 about a rotational axis 22), an elliptical raked helix, a wavy or sinusoidal raked helix, a higher order polynomial raked helix, a linear raked helix, or a combination of linear and/or non-linear raked helix.

The leading edge 13 begins at point 1, which will be the point where the leading edge 13 meets the root edge 15, and the leading edge 13 ends at point 8, which will be the point where the leading edge 13 meets the tip edge 16. Although in this embodiment, the leading edge 13 lies approximately on the three-dimensional surface of the circular raked helix 20, most points on the pitch surface 17 will not lie on the circular raked helix 20. The leading edge of this embodiment and the other embodiments described herein may approximately lie on the surface of the circular raked helix 20 because the ends of the blades 12 may be rounded off from their theoretical geometries for ease of manufacturing and to prevent sharp edges creating unwanted and or power-inefficient vortices. The leading edge of this embodiment and the other embodiments described herein may approximately lie on the surface of the circular raked helix 20 because the exact profile of the leading edge 13 relative to the circular raked helix 20 may intentionally deviate from the circular raked helix 20. The profile of the leading edge 13 may intentionally deviate from the circular raked helix 20 to more closely match the velocity vector profile of the incoming fluid to the profile of the leading edge 13 and/or the slope of the pitch surface 17 at the leading edge 13. Of course, all of the edges and corners of the blades 12 (the leading edge 13, the trailing edge 14, the root edge 15, the tip edge 16, and the trailing tip edge 19) will vary to some degree from their theoretically determined positions, due to similar rounding of sharp edges and corners and manufacturing convenience. The profile of the pitch surface 17 relative to the leading edge 13 will be discussed below, related to FIGS. 5A through 6B. In some embodiments (not shown), a larger portion of the profile of pitch surface 17 or the entire profile of pitch surface 17 may lie on the surface of the circular raked helix 20.

Figure 3C:
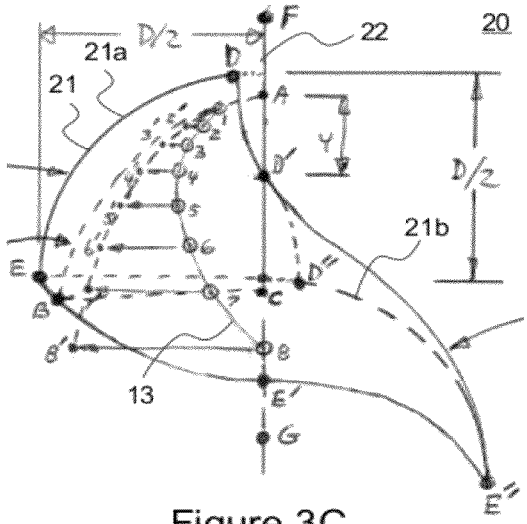
FIG. 3C is a diagrammatic side view of the circular raked helix depicted in FIG. 3A.
Figure 3D:
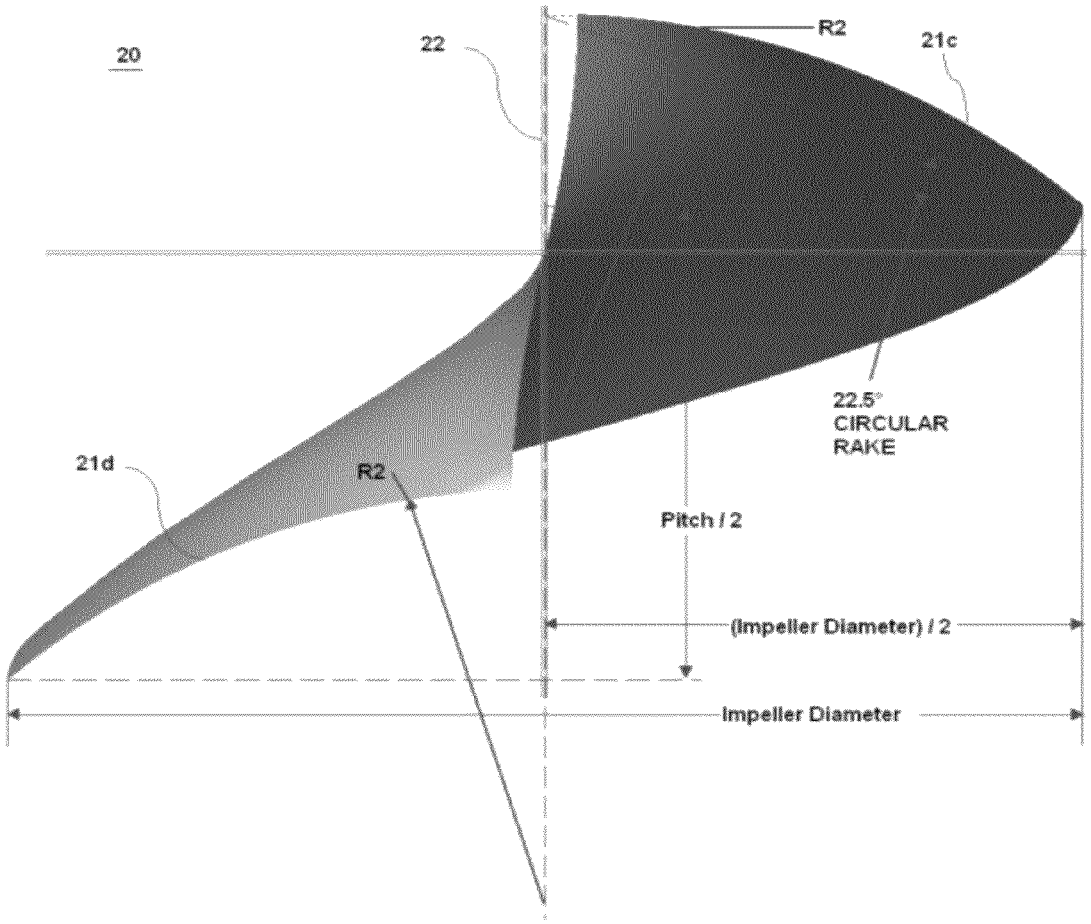
FIG. 3D is a side view of a second circular raked helix that may define the surface on which the leading edge of an impeller blade according to an aspect of the invention is located.
Figure 3E:
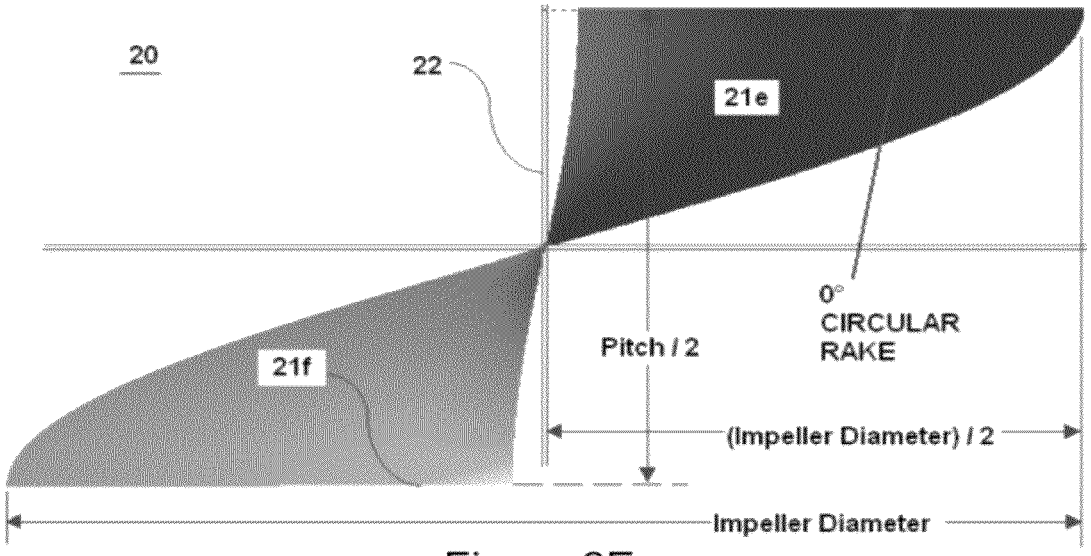
FIG. 3E is a side view of a linear zero-rake helix that may define the surface on which the leading edge of an impeller blade according to an aspect of the invention is located.

FIG. 3C is a diagrammatic side view of the circular raked helix depicted in FIG. 3A. As can be seen in FIG. 3C, the leading edge 13 approximately passes through space in the shape of a hemisphere as it rotates about the rotational axis 22 (the space is not exactly a hemisphere in this embodiment that has a skewed leading edge, but it may define a hemisphere in other embodiments, for example, in embodiments having a non-skewed leading edge or a leading edge profile defined via an exponential curve raked helix). The space through which the leading edge 13 passes through as it rotates can be seen from a side view in FIG. 3C. In FIG. 3C, the leading edge 13 begins at point 1 and continues through point 8. As the impeller 10 rotates about the rotational axis 22, points 1 through 8 of the leading edge 13 pass through points 1' through 8' in succession. Points 1' through 8' lie in a single plane in which the axis of rotation 22 lies. As can be seen in FIG. 3C, 1' through 8' define an elliptical arc that is somewhat close in geometric profile to the circular arc 21 that defines the circular raked helix at points 21*a* and 21*b*.

In other embodiments (not shown), the leading edge 13 may pass through space in a shape that more closely approximates a hemisphere, in which points 1' through 8' would define a circular arc. An example of such an alternative embodiment would be non-skewed leading edge 13 that extends, from a top view, linearly radially from the rotational axis 22 to the outermost tip of the leading edge 13. The degree of skew, therefore, defines a series of potential ellipse geometries, including a pure circle, through which the leading edge 13 may pass through space as it rotates about the rotational axis 22.

The exact choice of the profile of the leading edge 13 may be chosen based on the desired path that the leading edge 13 passes through as it rotates about the rotational axis 22. In the embodiments discussed above, the leading edge 13 passes through a hemispherical space or space that is somewhat close to a hemisphere. However, this shape swept by the leading edge 13 profile as it rotates about the rotational axis 22 may be fine-tuned to match any approximately-known constant velocity profile of the fluid on the intake side of the impeller 10 (the non-pitch face 18 side) in three-dimensional space.

In the embodiment of the impeller 10 that is designed for use to suspend particles in a storage tank, the velocity of the fluid on the intake side of the impeller 10 at a short distance from the non-pitch face 18 is near-zero velocity. In this embodiment, the inventor has observed that the three-dimensional surface at which the fluid velocity vectors transition from near-zero to substantially non-zero is approximately in the shape of a hemisphere, so the leading edge 13 is designed to sweep through three-dimensional space in approximately the same hemispherical geometric shape (but not exactly a hemisphere, as shown in FIGS. 3A-3C). However, in other embodiments, including those having near-zero or substantially non-zero velocity profiles near the non-pitch face 18, the leading edge 13 may be designed to sweep through three-dimensional space in approximately the geometric shape that matches a surface that connects the approximately-known points of constant velocity in the fluid near the non-pitch face 18.

In some embodiments, the velocity profile of the fluid to be mixed may be measured, and the leading edge 13 may be designed such that as it rotates about the rotational axis 22, it passes through a fluid at points at which the velocity is constant. The velocity profile of the fluid may be approximated by measuring the fluid velocity vectors produced by using an impeller 10 that does not have a leading edge 13 that matches the velocity profile, and then, a new impeller 10 may be designed that has a leading edge 13 that more closely matches the measured velocity profile. This fine-tuning of the leading edge 13 to a measured fluid velocity profile may be done iteratively, until experimental data confirm that the shape swept by the leading edge 13 more closely matches the measured fluid velocity profile. The inventor theorizes that this matching of the leading edge 13 profile with the velocity profile of the fluid to be mixed may result in a higher power-efficiency than impellers otherwise described herein that do not include this profile matching.

Figure 4A:
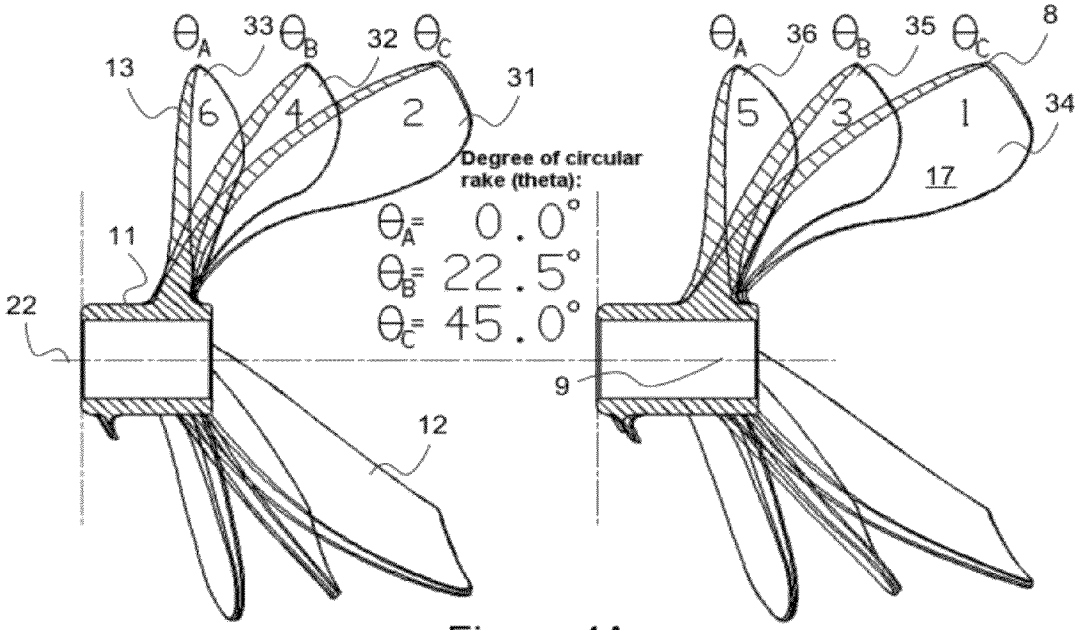
FIG. 4A are partial cutaway side views of an impeller series according to an aspect of the invention.
Figure 4B:
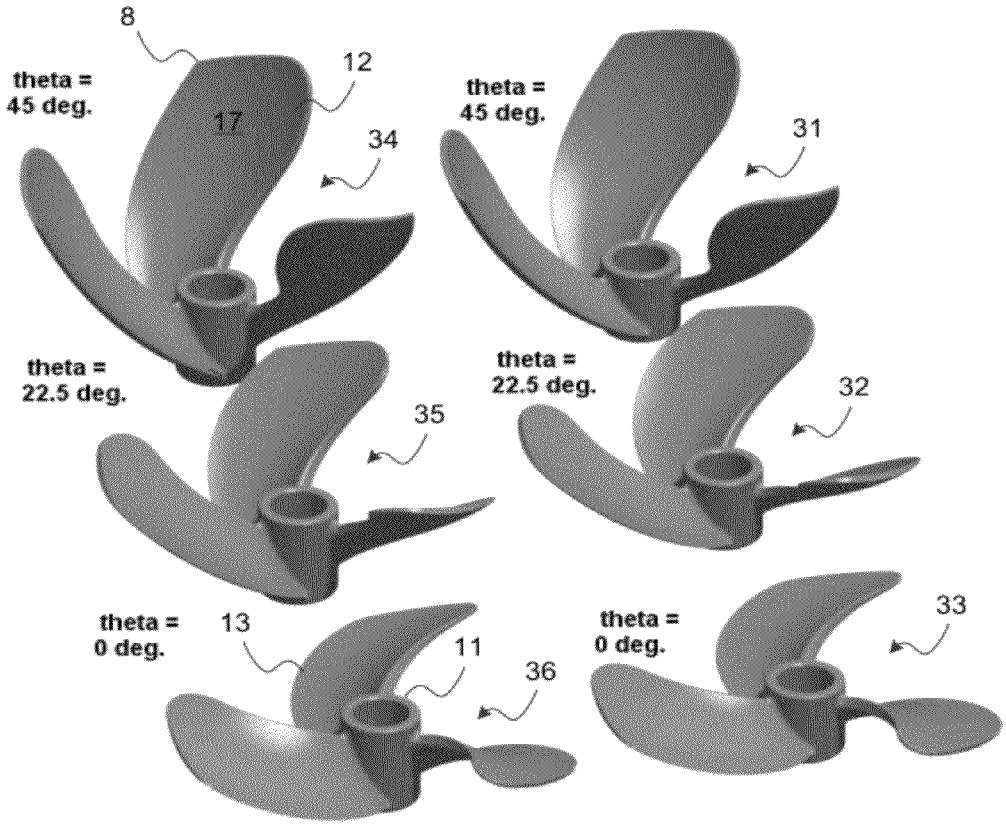
FIG. 4B are perspective views of the impeller series depicted in FIG. 4A.

FIG. 4A are partial cutaway side views of an impeller series according to an aspect of the invention. FIG. 4B are perspective views of the impeller series depicted in FIG. 4A. FIGS. 4A and 4B illustrate different potential embodiments of the impeller 10 that may be constructed by varying the degree of approximately-circular rake of the leading edge 13 profile of the blades 12, and by varying the pitch-to-diameter ratios used to define the pitch face 17.

As can be seen in FIG. 4A, impellers 31 and 34 have leading edge profiles 13 that are defined by projecting the top-view circular arc of the leading edge profile 13 seen in FIG. 2B onto a circular raked helix 20 formed as shown in FIG. 3A. As shown in FIG. 3A, the circular rake of 45 degrees is the angle between a first line normal to the rotational axis 22 and passing through the outermost point of arc 21*a* and a second line passing through the outermost point of arc 21*a* and the point where the arc 21*a* intersects the rotational axis 22. This 45-degree circular rake angle is defined in FIG. 4A as the angle $\theta_C$.

Impellers 32 and 35 have leading edge profiles 13 that are defined by projecting the top-view circular arc of the leading edge profile 13 seen in FIG. 2B onto a circular raked helix 20 formed as shown in FIG. 3D. As shown in FIG. 3D, the circular rake of 22.5 degrees is the angle between a first line normal to the rotational axis 22 and passing through the outermost point of arc 21*c* and a second line passing through the outermost point of arc 21*c* and the point where the arc 21*c* intersects the rotational axis 22. This 22.5-degree circular rake angle is defined in FIG. 4A as the angle $\theta_B$.

Impellers 33 and 36 have leading edge profiles 13 that are defined by projecting the top-view circular arc of the leading edge profile 13 seen in FIG. 2B onto a linear non-raked or zero-degree rake helix 20 formed from a straight line as shown in FIG. 3E. As shown in FIG. 3E, the line 21*e*, which is normal to the rotational axis 22 is defined as having a zero-degree rake. This zero-degree rake angle is defined in FIG. 4A as the angle $\theta_A$.

As can be seen in FIGS. 4A and 4B, the PDRs used to define the pitch face 17 vary between impellers 31, 32, 33 and impellers 34, 35, 36. The pitch faces 17 of the impellers 31-33 define a maximum PDR of 1.0 (at the trailing edges 14), while the pitch faces 17 of the impellers 34-36 define a maximum PDR of 1.5 (at the trailing edges 14). This higher maximum PDR defined by the impellers 34-36 can be seen in FIG. 4A, where in a side view, a greater area of pitch face 17 is visible in the depictions of impellers 34-36 than the area of pitch face 17 that is visible in impellers 31-33. The PDR that comprise the pitch face 17 of the blades 12 is discussed below in more detail, related to the FIGS. 5A-6B.

Figure 5A:
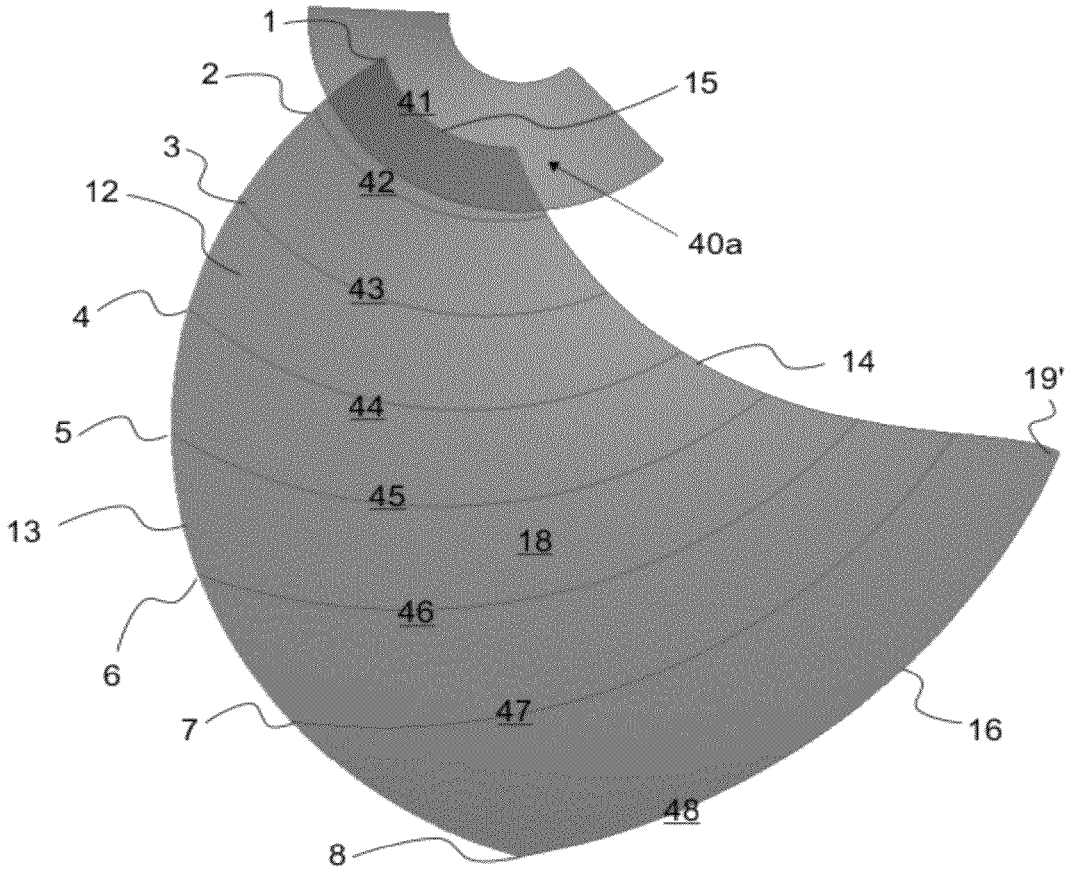
FIG. 5A is a top view of the pitch surface including camber lines of an impeller blade according to an aspect of the invention.
Figure 5B:
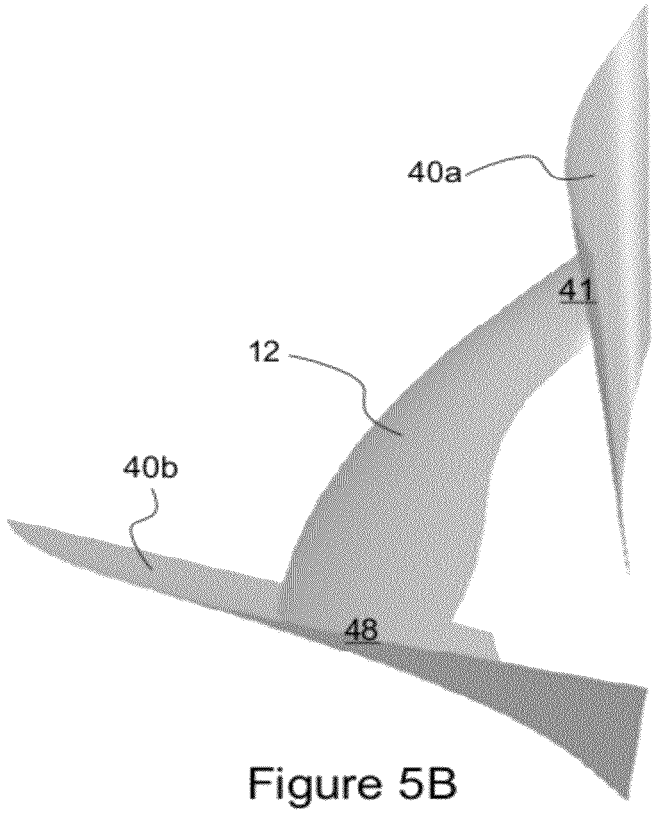
FIG. 5B is a side view of the pitch surface depicted in FIG. 5A.

FIG. 5A is a top view of the pitch surface including camber lines of an impeller blade according to an aspect of the invention. FIG. 5B is a side view of the pitch surface depicted in FIG. 5A. As can be seen in FIG. 5A, the geometry of each pitch face 17 may be defined by the radially equally spaced camber lines 41-48, which are anchored at one end to points 1-8 on the leading edge 13. In the embodiments described herein, any number of individual camber lines may be used to define the location of the pitch face relative to the leading edge or relative to any other coordinate system. For example, 4, 5, 6, 10, 12, 15, 20, or any other number of equally radially spaced or non-equally radially spaced camber lines may be used. In this embodiment, two concepts govern the geometry of the pitch face 17. The first concept is that the pitch face 17 incorporates a pitch (defined as known in the art, but modified to be relative to a conical helix coordinate system that will be described below) that exponentially varies from the leading edge 13 to the trailing edge 14 based on a predetermined mathematical function.

Figure 6A:
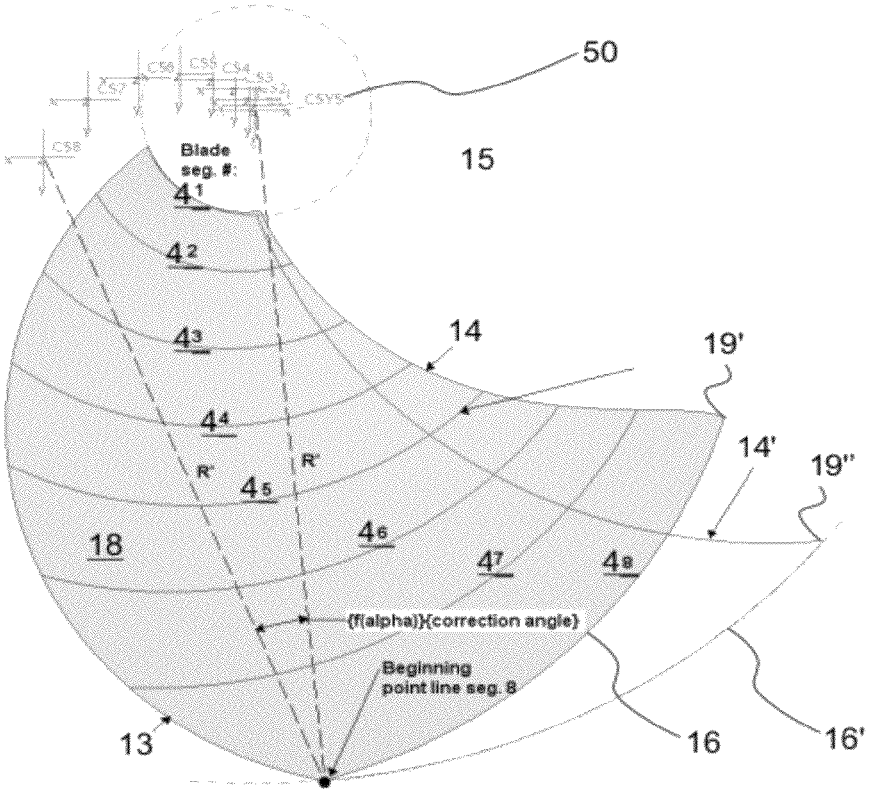
FIG. 6A is a top view of the pitch surface mathematical adjustment of an impeller blade according to an aspect of the invention.
Figure 6B:
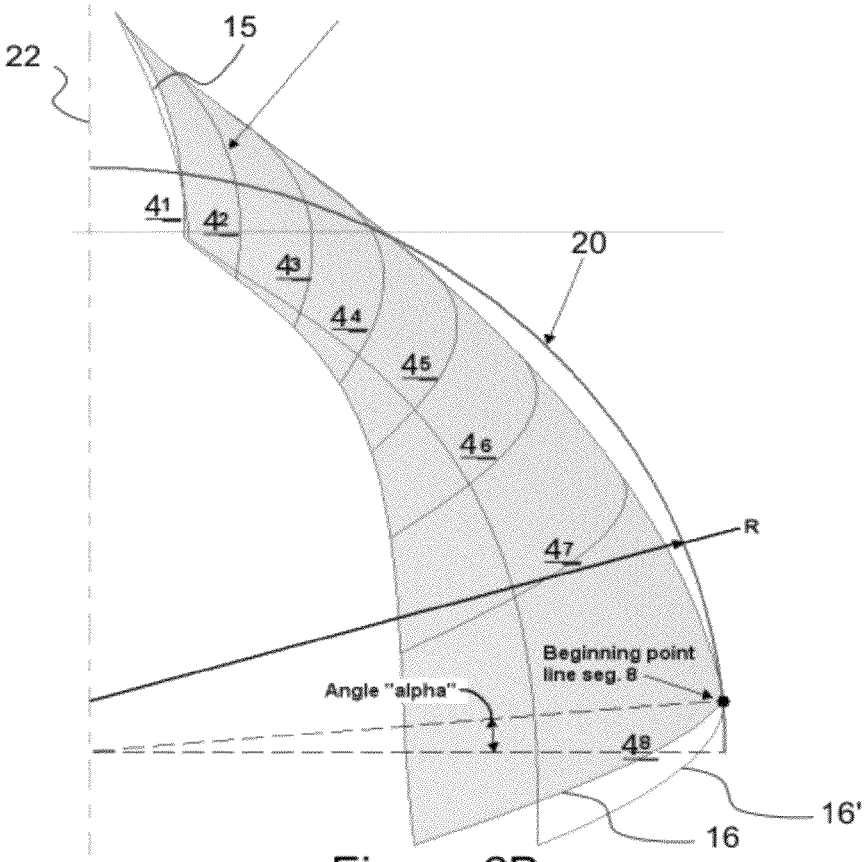
FIG. 6B is a side view of the pitch surface depicted in FIG. 6A.

The second concept that governs the geometry of the pitch face 17 is the overall design goal (in this embodiment) of achieving primarily axial flow near the root edge 15 and relatively greater radial flow near the tip edge 16. To achieve greater radial flow near the tip edge 16, the theoretical unrounded trailing edge tip 19' is bent inward towards the rotational axis 22 in a plane normal to the rotational axis 22. This bending is best shown in FIGS. 6A and 6B, and it essentially results in a greater inwardly radial force being applied to fluid particles that enter the mixing zone across the leading edge 13. The trailing edge tip 19' bending adjustment is discussed below in more detail, related to the FIGS. 6A and 6B.

Also, to define the geometry of the pitch face 17 between the leading edge 13 to the trailing edge 14, exponential camber lines (camber as used herein is defined to be the shape of the individual curves that run along the pitch face 17 from the leading edge 13 to corresponding points on the trailing edge 14) may be used. In this embodiment, exponential camber lines of the second order are used (e.g., a parabola), but in other embodiments, exponential camber lines of any order may be used. In this embodiment, exponential camber lines of the second order were chosen because the inventor theorized that they would help impart a constant acceleration onto fluid particles that enter the mixing zone at the leading edge 13.

The exact shape of each exponential camber line 41-48 may be determined by the required angle of travel about the rotational axis 22 to make each camber line 41-48 run from a respective starting point 1-8 that lies on the leading edge 13 to an ending point that lies on the trailing edge 14. In this embodiment, the position of the trailing edge 14 relative to the leading edge 13 about the rotational axis 22 was predetermined for a desired top view shape (as can be seen in FIGS. 2B and 5A). From a top view, the leading edge 13 and the trailing edge 14 each define circular arcs that pass through the rotational axis 22. In this embodiment, the leading edge 13 approximately defines a 90-degree arc, and the trailing edge 14 was chosen to provide for approximately 60% blade 12 coverage of the top view surface area inside the outer impeller 10 diameter (i.e., a 60% projected blade area ratio). Therefore, each of the three blades 12 cover about 20% of the total top view surface area, resulting in approximately a 72-degree rotational position distance about the rotational axis 22 between the leading edge 13 and the trailing edge 14. In other embodiments, any top view blade coverage surface area target may be used, and in these embodiments, the angular rotation distance between the leading edge 13 and the trailing edge 14 for a given blade 12 may be adjusted accordingly.

Once a desired angular distance between the leading edge 13 and the trailing edge 14 are determined, an exponential curve having predetermined beginning and ending pitch-to-diameter ratios may be fit to a line of the appropriate length and that has the appropriate average PDR. In this embodiment, a line of the appropriate length was chosen to represent the distance (in a conical helix coordinate system) between each point 1-8 on the leading edge 13 and the corresponding point on the trailing edge 14. Based on industry experience regarding effective PDRs for fluid acceleration, the inventor chose two different sets of PDRs for the two sets of embodiments of the impeller 10 shown in FIGS. 4A and 4B. In these embodiments, the leading edge PDR was chosen to be 0.5, the trailing edge PDR was chosen to be 1.0 for impellers 31-33 and 1.5 for impellers 34-36 (as shown in FIGS. 4A and 4B), and the average PDRs were 0.75 for impellers 31-33 and 1.0 for impellers 34-36. Based on industry experience, a higher average PDR should allow an impeller to achieve higher fluid velocities in the mixing zone, but at the cost of higher required power. In other embodiments, the leading edge, trailing edge, and average PDRs should be chosen to optimize the desired fluid velocities and the fluid volume flow in the mixing zone for the particular desired use (e.g., the particular viscosity of the fluid, the distance of the far tank wall from the impeller, the maximum allowable tip speed, the maximum allowable outer impeller diameter, etc.).

In this embodiment, once a desired exponential function was chosen to represent the pitch variation from the leading edge 13 to the trailing edge 14 at a given distance to the rotational axis 22, each exponential function was anchored to the starting point 1-8 on the leading edge 13, and each exponential function was transformed into a respective conical helix coordinate system to determine the profile face 17. As can be seen in FIGS. 5A and 5B, each conical helix coordinate system is basically a conical helix, rotated about the rotational axis 22, at an angle such that the surface defined by each conical helix is normal to the leading edge 13 at each of the respective points 1-8. In this embodiment, each conical helix defines an inward rake angle that allows the conical helix surface to be normal to the leading edge 13 at the respective point 1-8. Therefore, as can be seen in FIG. 5B, the inward rake angle of the conical helix 40*a* that is normal to point 1 on the leading edge 13 is relatively large (perhaps 80 degrees), but the inward rake angle of the conical helix 40*b* that is normal to point 8 on the leading edge 13 is relatively small (perhaps 10 degrees). To produce the camber line 41 that originates at point 1, for example, the predetermined exponential camber function is transformed into the respective conical helix coordinate system 40*a*, while to produce the camber line 48 that originates at point 8, the predetermined exponential camber function is transformed into the respective conical helix coordinate system 40*b*. In between the camber lines 41-48, the remaining surface of the profile face 17 may be exponentially extrapolated using any method that is known in the art.

FIG. 6A is a top view of the pitch surface mathematical adjustment of an impeller blade according to an aspect of the invention. FIG. 6B is a side view of the pitch surface depicted in FIG. 6A. Regarding the second concept for defining the geometry of the pitch face 17, the exponential camber lines produced as described above may be further modified to meet the overall design goal (in this embodiment) of achieving primarily axial flow near the root edge 15 and relatively greater radial flow near the tip edge 16.

To achieve greater radial flow near the tip edge 16, the theoretical unrounded trailing edge tip 19' is bent inward towards the rotational axis 22 in a plane normal to the rotational axis 22. In this embodiment, this is accomplished by moving the center of the coordinate system for each of the conical helixes 40 in a plane normal to the rotational axis 22 of the impeller 10. The center of the coordinate system for each of the conical helixes 40 was moved by rotating the position in the horizontal plane about the beginning point of each section (as viewed from a top view as in FIGS. 2B, 5A, and 6A). The amount each coordinate system is rotated is governed by a correction angle that is equal to the cosine of the inward rake angle of each respective conical helix 40, also defined as angle alpha in FIG. 6B. In this embodiment, this means that the angular correction for camber curve 41, which has a large inward rake angle, would be relatively small (the cosine of an angle near 90 degrees is approximately zero), while the angular correction for camber curve 48, which has a small inward rake angle, would be relatively large (the cosine of an angle near zero degrees is about 1.0). In this embodiment, the adjustment of about 1.0 for camber curve 48 was applied to the target pitch angle, which for the embodiment shown as impeller 34 in FIGS. 4A and 4B and impeller 10 in FIG. 2A, was about 17.657 degrees, which is the attack angle at the tip of a typical helical propeller design at a PDR of 1.0 and at the same distance from the rotational axis 22, and it was applied to the target pitch angle at the point 8 on the leading edge 13 (which for the embodiment shown as impeller 34 in FIGS. 4A and 4B and impeller 10 in FIG. 2A, was about zero degrees.

Of course, in other embodiments, the adjusted target leading edge tip and trailing edge tip angles may vary depending on the desired performance requirements, manufacturing requirements, and the like. In the embodiment shown in FIGS. 6A and 6B, the particular pitch adjustment scheme was chosen because of the particular design goal of having the blade 12 portion near the root edge 15 produce primarily axial flow, while the blade 12 portion near the tip edge 16 produces primarily radial flow. In this embodiment, the target adjusted pitch angles essentially would result in a greater inwardly radial force being applied to fluid particles that enter the mixing zone across the leading edge 13 near the tip edge 16, compared to an impeller without the same adjustment. It was also desired to design a blade 12 that, in use, would permit fluid particles that enter the mixing zone across the leading edge 13 to follow a single camber line 41-48 as it travels across the pitch face 17 towards the trailing edge 14, for conformance to performance predicted by the adherence of a given fluid particle to a path defined by a given pitch face line 41-48.

As can be seen in FIG. 1, the geometry of the non-pitch face 18 generally follows the geometry of the pitch face 17, although with an offset distance that varies between various locations on the pitch face 17. In the embodiment shown in FIG. 1, the non-pitch face 18 follows the profile of the pitch face 17, with an offset normal to the pitch face 17 at each position on the pitch face 17, of a distance such that the leading edge 13 portion of the blade 12 is thicker than the trailing edge 14 portion, and the root portion 15 is thicker than the tip portion 16, with a taper from the leading edge 13 to the trailing edge 14, as well as a taper from the root edge 15 to the tip edge 16, where both tapers generally resemble the style of tapers used in a typical airfoil design. In other embodiments, other relationships between the geometry of the non-pitch face 18 and the pitch face 17 may be used, including a strict linear relationship, a parabolic or exponential relationship, or any other relationship that is known in the art and may enhance the performance or achievement of other design goals.

Figure 7:
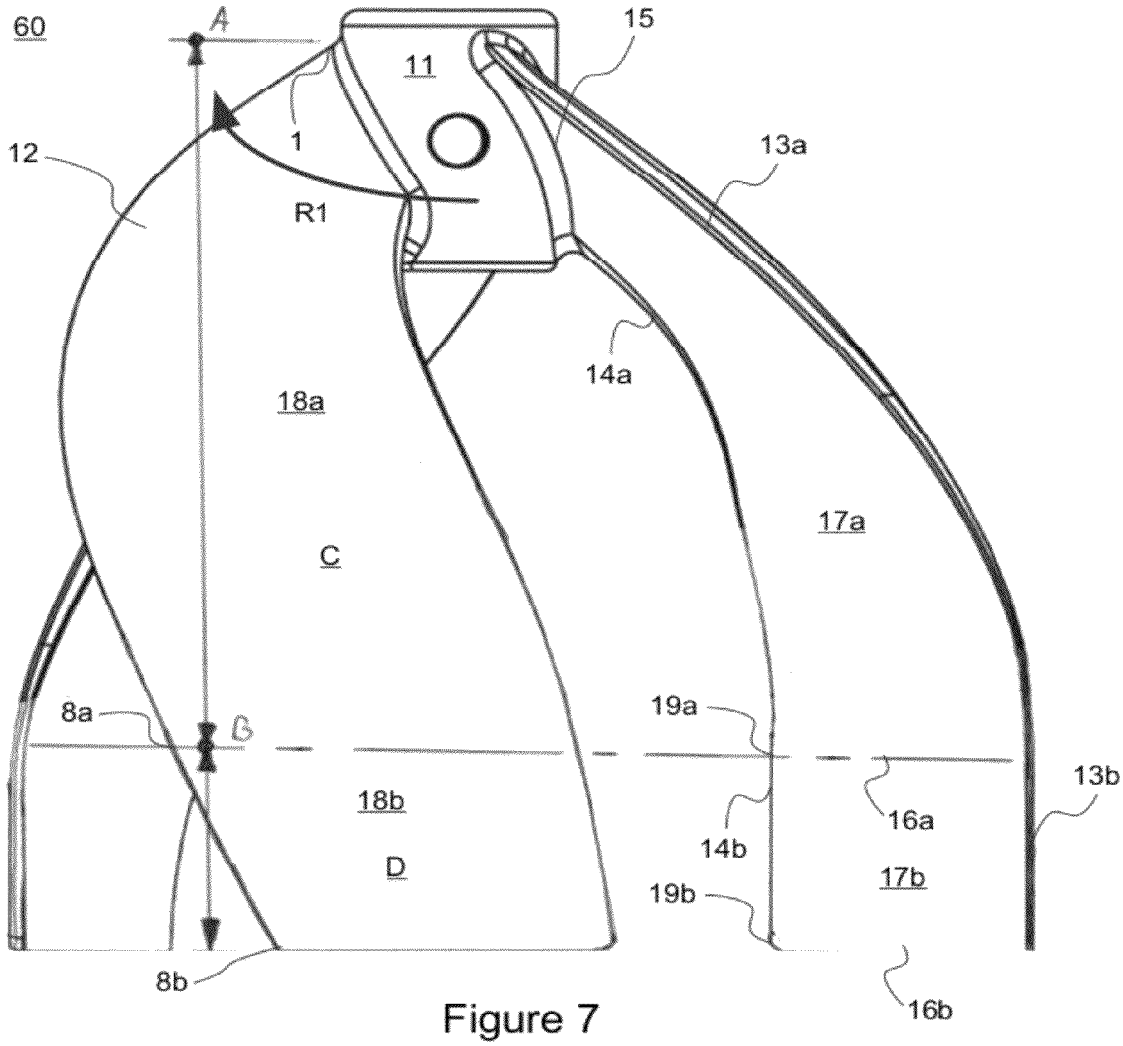
FIG. 7 is a side view of an impeller including extended radial pumping blade portions according to an aspect of the invention.

FIG. 7 is a side view of an impeller including extended radial pumping blade portions according to an aspect of the invention. In this embodiment, the design goal of achieving primarily axial flow near the root edge 15 and relatively greater radial flow near the tip edge 16*a* is further enhanced. As can be seen in FIG. 7, impeller 60 incorporates an additional blade 12 tip zone D, which is an extension of the original tip edge 16*a* of the blade 12 inner zone C, that may produce almost entirely inward radial pumping of fluid. Therefore, impeller 60 may produce primarily axial flow near the root edge 15, gradually transitioning along blade 12 from point A to point B towards producing primarily inwardly radial flow near the tip edge 16*a* of the inner zone C, then producing almost entirely inward radial flow in the additional tip zones D.

As can be seen in FIG. 7, impeller 60 begins with the design of impellers 31 and 34 that are shown in FIGS. 4A and 4B, which is represented by inner zone C of the blades 12, but an extended tip zone D is also provided. Compared to impellers 31 and 34 that are shown in FIGS. 4A and 4B, impeller 60 includes tip zones D in blades 12 that extend a longer distance along the axis of rotation (i.e., impeller 60 has a longer portion of the blades 12 near the tip edges 16*b* that behave in a manner resembling that of a traditional inwardly pumping radial impeller). However, in a plane normal to the axis of rotation, the additional tip zones D do not increase the impeller diameters of impellers 31 and 34 (i.e., the top views of the impeller 60 will look similar to the top views of the impellers 31 and 34, as shown in FIG. 2B).

In the embodiment shown in FIG. 7, the pitch face 17*b* of each extended tip zone D is identical to the pitch face at the former tip edge 16*a*. The pitch face 17*b* of these additional tip zone D sections may have exponential (e.g., parabolic) camber lines (that are also transformed into a cylindrical coordinate system centered on the axis of rotation) as in the embodiments discussed above, with a predefined angle at the point 8*b* on the leading edge 13*b* (and a constant angle for the rest of leading edge 13*b*) and a predefined angle at the trailing edge tip 19*b* on the trailing edge 14*b* (and a constant angle for the rest of the leading edge 14*b*). While the angles of the leading and trailing edges of the additional tip zones D for this embodiment are constant, in other embodiments, the angles of the leading and trailing edges may vary along the leading and trailing edges. Although not shown in FIG. 7, if additional tip zones D extend far enough from the hub 11 along the rotational axis 22, the blades 12 may require support bands, positioned around the blades 12 around the extended top zones D in a plane that is normal to the rotational axis 22, so that the blades 12 do not experience an excessive centrifugal force stress.

FIGS. 8A and 8B depict an example embodiment of an impeller that includes the leading edge of each blade being defined by projecting the top-view arc of the leading edge profile onto the surface of a circular raked helix (the helix axis being substantially coincident with the impeller axis of rotation). The circular raked helix may be generated, for example, as described with reference to FIGS. 3A-3E. An example environment for use of the impeller 70 shown in FIGS. 8A and 8B may be an anoxic mixing basin, as can be found in a municipal waste water treatment facility. In such an environment, the blade diameter to tank diameter ratio may be relatively small, such as, for example, 0.25-0.45. However, the impeller 70 may be used in any environment with any blade diameter to tank diameter ratio.

Referring now to FIGS. 8A and 8B, an impeller 70 includes a hub 71*a* having plural flanges 71*b*, and plural blades 72. Impeller 70 preferably rotates about the hub 71*a* in a rotational direction R1. Each blade 72 is spaced circumferentially about the hub 71*a*, and each blade 72 includes a leading edge 73, a trailing edge 74, a root edge 75*a*, a stiffness insert 75*b*, a tip edge 76, a pitch face 77, a non-pitch face 78, and an anti-vortex fin 79. The impeller 70 is preferably attached via the hub 71*a* to a drive shaft (not shown) for extending into a tank containing fluid. The hub 71*a* is preferably attached to the drive shaft via a keyway, but any other known mechanism may be used, including a spline, set screws, welding, or chemical bonding. Each blade 72 may be attached to the hub 71*a* via bolting to a respective flange 71*b*, but the blades 72 may also be attached to the hub 71*a* by any other known mechanism, including clamping, welding, chemical bonding, or integrally forming each blade 72 to the hub 71*a*. As shown, each flange 71*b* extends from the hub 71*a* at a 39° angle to a horizontal plane that is perpendicular to the longitudinal axis of the hub 71*a*. In other embodiments, each flange 71*b* may extend from the hub 71*a* at any angle to the horizontal.

In order for the impeller 70 to produce a mixing zone that is sufficiently collimated and efficient for a given diameter impeller 70, the geometry of the pitch faces 77 of the blades 72 of the impeller 70 are designed to produce primarily axial flow at the root edges 75*a* of the blades 72 and to produce a combination of radial and axial flow at the tip edges 76 of the blades 72.

In order to enhance the power efficiency of the impeller 70, the impeller 70 preferably approximately matches the geometry of the leading edge 73 to the constant-velocity profile of the fluid on the intake side. The inventor surmises that an impeller 70 that has leading edges 73 of the blades 72 that approximately passes through space in the shape of a hemisphere as it rotates (in any given two-dimensional plane that passes through the axis rotation of the impeller 70, this shape will be approximately a circular arc) will be a, possibly the most, power-efficient design for this intended environment. The detailed shape of the leading edges 73 of the blades 72 of the impeller 70 can be seen and understood by reference to FIGS. 3A through 3C and the accompanying text above.

Impeller 70 or any of the other impeller embodiments described herein may be made of fiberglass reinforced plastic for the majority of the blade, and the impeller 70 may include a stainless steel stiffness insert 75*b* extending from the hub 71 through a portion (e.g., the radially innermost 20%) of the blades 72. For example, the stiffness insert 75*b* may penetrate approximately 12 inches into the radially innermost portion of the blades 72 of an impeller 70 having a 50-inch outer diameter. The stiffness insert 75*b* may allow for a stronger coupling between the hub 71*a* and/or the flanges 71*b* and the blades 72. The stiffness insert 75*b* may provide additional strength, stiffness, and/or bending resistance for the approximately 20% inner-most portion of the blades 72.

In this embodiment, the leading edges 73 of the blades 72 of the impeller 70 are defined by projecting the desired top view profile (e.g., the top view profile of the leading edges 73 are shown in FIG. 8B as a circular arc) onto the surface of a 10-degree circular raked helix. The circular raked helix used in this embodiment is constructed in a similar manner as that described and shown with reference to FIGS. 3A-3E and FIGS. 4A-4B.

As best shown in FIG. 8B, the leading edges 73 of the blades 72 may be hyper-skewed. As used herein, hyper-skewed means having a top-view leading edge blade profile that defines a curve that traverses more than one quadrant of a traditional Cartesian coordinate system (e.g., an arc that is greater than 90 degrees), where the origin of the Cartesian coordinate system is located at the center of the hub. As discussed above, the degree of skew may depend on the length of the arc that defines the top-view of the leading edge 73. For example, a leading edge 73 that defines a 45-degree arc from a top view will be less skewed than a leading edge 73 that defines a 90-degree arc from a top view. As shown in FIG. 8B, the leading edges 73 may have a hyper-skewed profile, i.e., a leading edge that defines an arc from a top view that is greater than 90 degrees. For example, the leading edge 73 shown in the Figures defines a 160-170 degree arc from a top view, so the leading edge has a hyper-skewed profile. The inventor surmises that the greater the skew of the profile of the leading edge, the more resistant an impeller blade may be to "ragging," which is the build-up of stringy and fibrous rag-like debris at the end 8 of the leading edge 73. Also, the inventor surmises that the greater the skew of the profile of the leading edge, the amount of drag an impeller blade may experience during rotation of the impeller in the direction R1 may be reduced.

In an impeller 70 that includes a hyper-skewed top-view leading edge 73 projected onto a circular raked helix, the top edges 76 of the blades 72 may extend or reach downward (i.e., further away from the hub 71*a* along the rotational axis of the hub 71*a*) to a further degree than if the leading 73 edge was not hyper-skewed. Such a greater downward reach of the blades 72 may allow the blades 72 to reach a particular downward distance into a liquid while using a shaft having a shorter length.

As can be seen in FIG. 8A, the pitch face 77 of the blades 72 defines a maximum PDR of 1.5 at the trailing edge 74, the pitch face 77 defines a minimum PDR of 0.5 at the leading edge 73, and the average PDR throughout the pitch face 77 was defined to be 1.0.

As discussed with reference to FIGS. 5A and 5B, to define the geometry of the pitch face 77 between the leading edge 73 to the trailing edge 74, exponential camber lines may be used. For example, an exponential function may be transformed into a respective conical helix coordinate system to determine the profile face 77 at each camber line 41-48, as shown and discussed above relative to FIGS. 5A and 5B. In this embodiment, exponential camber lines of the second order are used (e.g., a parabola), but in other embodiments, exponential camber lines of any order may be used. To define the pitch face 77 of the blades 72, an exponential curve having the aforementioned beginning and ending PDRs was fit to a line of the appropriate length and that has the appropriate average PDR.

Impeller 70 may include an anti-vortex fin 79 on each blade 72. As shown in FIGS. 8A and 8B, the anti-vortex fin 79 extends away from the pitch face 77 of the blades 72 in a direction that is substantially perpendicular to the pitch face 77. The anti-vortex fin 79 extends longitudinally along the tip edge 76 and along the outermost portion (closest to point 8) of the leading edge 73. The inventor surmises that the anti-vortex fin 79 may improve the mechanical efficiency of the impeller 70 by reducing the amount of vortices produced near the tip edge 76 during rotation of the impeller 70 in the direction R1, thereby reducing the amount of drag experienced by the blades 72.

Figure 9A:
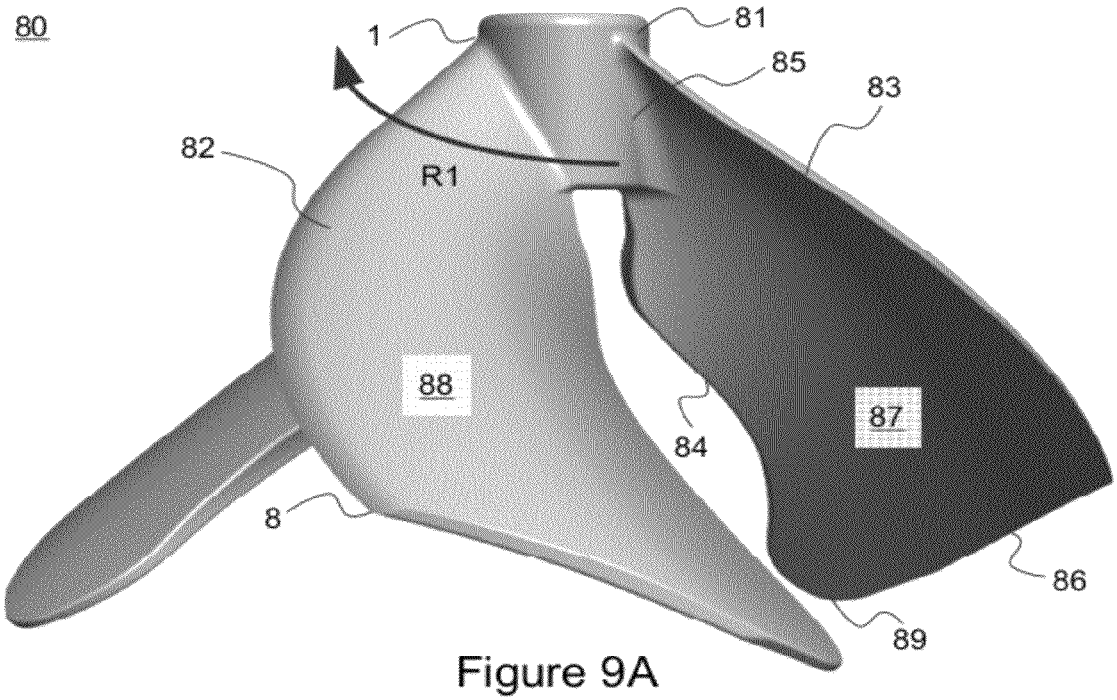
FIG. 9A is a side view of an impeller having a leading edge that slightly deviates from the surface of a circular raked helix.
Figure 9B:
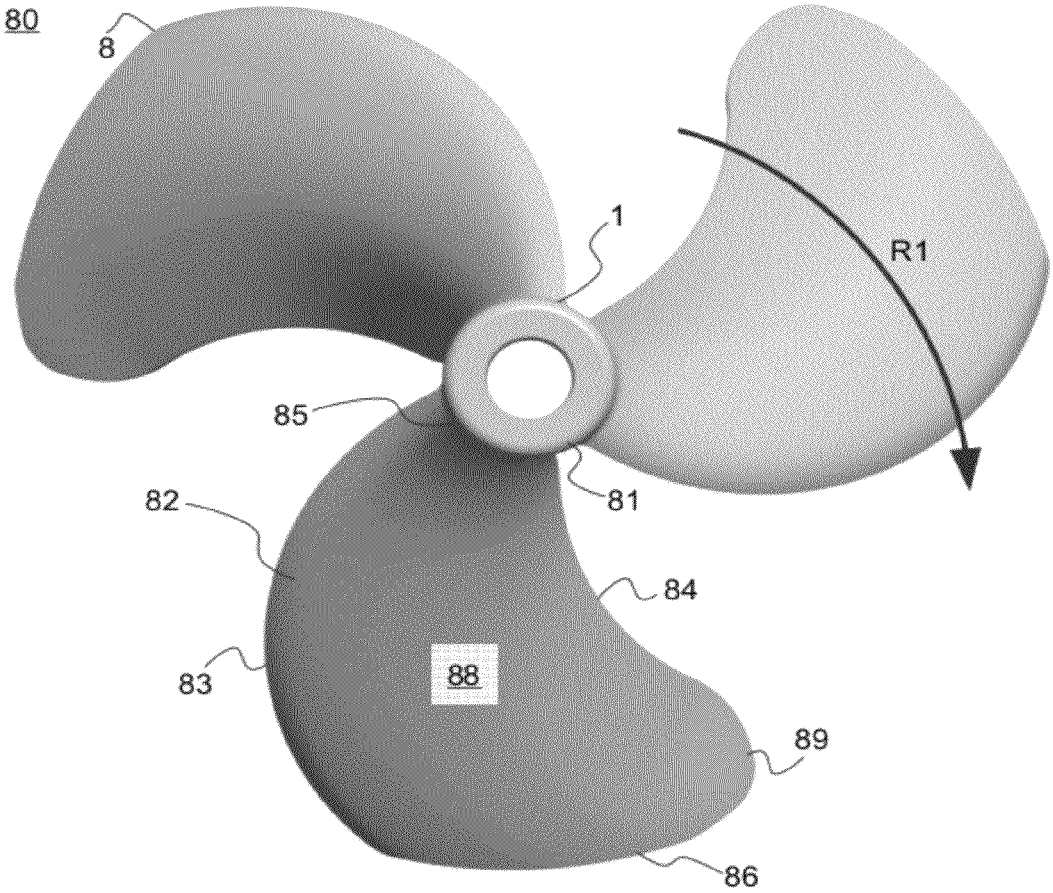
FIG. 9B is a top view of the impeller depicted in FIG. 9A.

FIGS. 9A and 9B depict an example embodiment of an impeller that includes the leading edge of each blade slightly deviating from being defined by projecting the top-view arc of the leading edge profile onto the surface of a circular raked helix (the helix axis being substantially coincident with the impeller axis of rotation). The circular raked helix may be generated, for example, as described with reference to FIGS. 3A-3E.

Referring now to FIGS. 9A and 9B, an impeller 80 includes a hub 81 and plural blades 82. Impeller 80 preferably rotates about the hub 81 in a rotational direction R1. Each blade 82 is spaced circumferentially about the hub 81, and each blade 82 includes a leading edge 83, a trailing edge 84, a root edge 85, a tip edge 86, a pitch face 87, a non-pitch face 88, and a trailing edge tip 89. The impeller 80 is preferably attached via the hub 81 to a drive shaft (not shown) for extending into a tank containing fluid. The hub 81 is preferably attached to the drive shaft via a keyway, but any other known mechanism may be used, including a spline, set screws, welding, or chemical bonding. Each blade 82 may be integrally formed to the hub 81 in a single casting, but the blades 82 may also be attached to the hub 81 by any other known mechanism, including bolting, clamping, welding, or chemical bonding.

In order for the impeller 80 to produce a mixing zone that is sufficiently collimated and efficient for a given diameter impeller 80, such that the mixing zone reaches a tank wall 200 feet away, the geometry of the pitch faces 87 of the blades 82 of the impeller 80 is designed to produce primarily axial flow at the root edges 85 of the blades 82 and to produce a combination of radial and axial flow at the tip edges 86 of the blades 82.

Given the complexity of fluid flows in many environments, the fluid flow in and around the blades 82 of the impeller 80 at all portions of the impeller 80 may include velocity vectors in both axial and radial directions simultaneously. The blades 82 preferably accomplish primarily axial flow at the root edges 85 and a combination of radial and axial flow at the tip edges 86, preferably, by defining a smoothly varying pitch face 87 that transitions between the axial flow portion of the blades 82 and the radial flow portion of the blades 82.

In order to enhance the power efficiency of the impeller 80, the impeller 80 preferably approximately matches the geometry of the leading edge 83 to the constant-velocity profile of the fluid on the intake side, for the case of near-zero velocity reservoirs, which is the side of the non-pitch faces 88 of the blades 82 of the impeller 80. In the embodiment of mixing crude oil and its derivatives in an oil storage tank, or in the embodiment of mixing liquid in an anaerobic digester tank, the fluid on the intake side of the impeller 80 has a near-zero velocity at a relatively small distance (e.g., 10 impeller diameters away from the leading edge 83) from the intake side of the impeller 80. At points very close to the intake side of the impeller 80, once the impeller 80 begins rotating in a direction R1, there is a non-zero velocity zone on the intake side. The inventor surmises that an impeller 80 that has leading edges 83 of the blades 82 that approximately passes through space in the shape of a hemisphere as it rotates (in any given two-dimensional plane that passes through the axis rotation of the impeller 80, this shape will be approximately a circular arc) will be a, possibly the most, power-efficient design for this intended near-zero velocity sump or reservoir. The approximate detailed shape of the leading edges 83 of the blades 82 of the impeller 80 can be seen and understood by reference to FIGS. 3A through 3C and the accompanying text above.

In this embodiment, the leading edges 83 of the blades 82 of the impeller 80 are substantially defined by projecting the desired top view profile (e.g., the top view profile of the leading edges 83 are shown in FIG. 9B as a circular arc) onto the surface of a 22.5-degree circular raked helix. The circular raked helix used in this embodiment is constructed in a similar manner as that described and shown with reference to FIGS. 3A-3E and FIGS. 4A-4B. The present invention contemplates impeller blades having a leading edge that deviates by a small amount from being defined by projecting the top view profile onto the surface of a circular raked helix. For example, each point (e.g., points 1-8) on the leading edges 83 of the blades 82 of the impeller 80 may deviate from the surface of the circular raked helix (e.g., a 22.5-degree circular raked helix) by up to 5% of the height and radial distance and up to 5° of the angular position, as defined by a cylindrical coordinate system with its origin passing through the geometric center of the hub 81. Preferably, each point on the leading edges 83 may deviate from the surface of the circular raked helix by up to 3% of the height and radial distance and up to 3° of the angular position. Most preferably, each point on the leading edges 83 may deviate from the surface of the circular raked helix by up to 1% of the height and radial distance and up to 1° of the angular position.

The particular degree of deviation of the leading edge 83 from being defined by projecting the top view profile of the leading edge 83 onto the surface of a circular raked helix may be chosen based on the desired path that the leading edge 83 passes through as it rotates about the rotational axis. However, this shape swept by the leading edge 83 profile as it rotates about the rotational axis may be fine-tuned to match any approximately-known constant velocity profile (e.g., a hemisphere) of the fluid on the intake side of the impeller 80 (the non-pitch face 88 side) in three-dimensional space.

As discussed with reference to FIGS. 5A and 5B, to define the geometry of the pitch face 87 between the leading edge 83 to the trailing edge 84, exponential camber lines may be used. In this embodiment, exponential camber lines of the second order are used (e.g., a parabola), but in other embodiments, exponential camber lines of any order may be used.

The particular chosen shape of each exponential camber line 41-48 may be partially determined by the required angle of travel about the rotational axis (a longitudinal axis located at the geometric center of the hub 81) to make each camber line 41-48 run from a respective starting point 1-8 that lies on the leading edge 83 to an ending point that lies on the trailing edge 84, as described above with reference to FIGS. 5A and 5B. As described above, any number of equally radially spaced or non-equally radially spaced camber lines may be used to define the surface of the pitch face 87 relative to the leading edge 83 or relative to any other coordinate system. For example, in the embodiment shown in FIGS. 9A and 9B, the blades 82 provide approximately 60% coverage of the top view surface area inside the outer impeller 80 diameter. Therefore, each of the three blades 82 cover about 20% of the total top view surface area, resulting in approximately a 72-degree rotational position distance about the rotational axis between the leading edge 83 and the trailing edge 84.

As can be seen in FIG. 9A, the pitch face 87 of the blades 82 defines a maximum pitch-to-diameter ratio of 1.875 at the trailing edge 84. In some embodiments, a separate PDR for the pitch face 87 at the trailing edge 84 may be individually chosen for each camber line 41-48. Any maximum PDR may be used for each of the points along the trailing edge 84, depending on the desired degree and angle of acceleration of the fluid as it travels across the blades 82.

To set the PDR of the pitch face 87 at the leading edge 83, the PDR at each starting point 1-8 may be set such that the "attack" angle of the pitch face 87 at the leading edge 83 at a particular point 1-8 is equal to or slightly greater (e.g., at most 3° greater, preferably at most 2° greater, and most preferably at most 1° greater) than the angle at which the fluid particles strike the leading edge 83 during rotation of the impeller 80 in the R1 direction. The attack angle of the pitch face 87 at the leading edge 83 at a particular point 1-8 may be greater than the angle at which the fluid particles strike the leading edge 83 during rotation of the impeller 80 by an amount equal to the manufacturing tolerance of the attack angle of the pitch face 87. For example, if, at a particular point 1-8, the manufacturing tolerance of the attack angle of the pitch face 87 is ±1°, the attack angle of the pitch face 87 at a particular point 1-8 may be designed to be nominally 1° greater than the angle at which the fluid particles strike the leading edge 83 during rotation of the impeller 80, such that, taking the manufacturing tolerance into consideration, the attack angle of the pitch face 87 will be 0-2° greater than the angle at which the fluid particles strike the leading edge 83 during rotation of the impeller 80.

The attack angle of the pitch face 87 at the leading edge 83 may be different for each point 1-8 along the leading edge 83. As used herein, the attack angle of the pitch face 87 at the leading edge 83 is defined as the angle that the pitch face 87 at the leading edge 83 makes relative to a plane that is perpendicular to the axis of rotation of the impeller 80, the angle of the pitch face 87 and the plane being measured in a cylindrical plane at a given radius from the axis of rotation. As used herein, the angle at which the fluid particles strike the leading edge 83 is defined as the angle that the fluid particle velocity vector makes relative to a plane that is perpendicular to the axis of rotation of the impeller 80, the angle at which the fluid particles strike the leading edge 83 and the plane being measured in a cylindrical plane at a given radius from the axis of rotation. As used herein, the fluid particle velocity vector at any given point is the vector sum of the velocity vector of a given leading edge radial location due to its rotational motion (i.e., RPM*2*π*radius) and the velocity vector of the incoming fluid at the point on the leading edge where the rotational velocity vector was computed.

The PDR of the pitch face 87 at the leading edge 83 at each particular point 1-8 may be chosen by performing a CFD simulation of the fluid particle velocity vectors to approximately match the fluid particle velocity vectors to the attack angle of the leading edge 83 for a particular embodiment of the impeller 80. Once a desired PDR is chosen for each point 1-8 along the leading edge 83, and once the top view angular distance between the leading edge 83 and the trailing edge 84 is determined, an exponential curve having predetermined beginning and ending PDRs may be fit to a line of the appropriate length and that has the appropriate average PDR. In this embodiment, the average PDR for each camber line 41-48 running along the pitch face 87 of the blades 82 was chosen to be the mean of the leading edge PDR and the trailing edge PDR for each camber line 41-48.

In this embodiment, once a desired exponential function was chosen to represent the pitch variation from the leading edge 83 to the trailing edge 84 at a given distance to the rotational axis, each exponential function was anchored to the starting point 1-8 on the leading edge 83, and each exponential function was transformed into a respective conical helix coordinate system to determine the profile face 87, as shown and discussed above relative to FIGS. 5A and 5B. In between the camber lines 41-48, the remaining surface of the profile face 87 may be exponentially extrapolated using any method that is known in the art. Then, the exponential camber lines produced as described above may be further modified, as described above with reference to FIGS. 6A and 6B, to meet the overall design goal (in this embodiment) of achieving primarily axial flow near the root edge 75 and relatively greater radial flow near the tip edge 76.

In the embodiment shown in FIGS. 9A and 9B, the hub 81 has a smaller vertical height (measured along the axis of rotation) than the vertical height of the root edge 85 of each blade 82, such that a portion of the root edge 85 hangs down below the bottom of the hub 81, and a portion of the root edge 85 may be attached to the underside of the hub 81. The difference in height between the root edge 85 and the hub 81 may be any amount, including, for example, wherein the root edge 85 has approximately twice the vertical height of the hub 81. Having the vertical height of the root edge 85 greater than that of the hub 81 may save weight by reducing the weight of the hub 81 relative to embodiments where the vertical height of the hub 81 is equal to or greater than the vertical height of the root edge 85. Having the vertical height of the root edge 85 greater than that of the hub 81 may increase the strength of the attachment location between the root edge 85 and the hub 81 relative to embodiments where the vertical height of the hub 81 is equal to or greater than the vertical height of the root edge 85. Having the vertical height of the root edge 85 greater than that of the hub 81, thereby saving weight in the hub 81, may raise the first fundamental natural vibration frequency of the impeller-and-shaft system. Because an impeller-and-shaft system may be designed not to have the operating speed (RPM) exceed, for example, 80% of the first natural frequency of the impeller-and-shaft system, raising the first natural frequency of the impeller-and-shaft system may allow a user to operate the impeller at a higher RPM without risking system failure due to deflections of the impeller.

Figure 10:
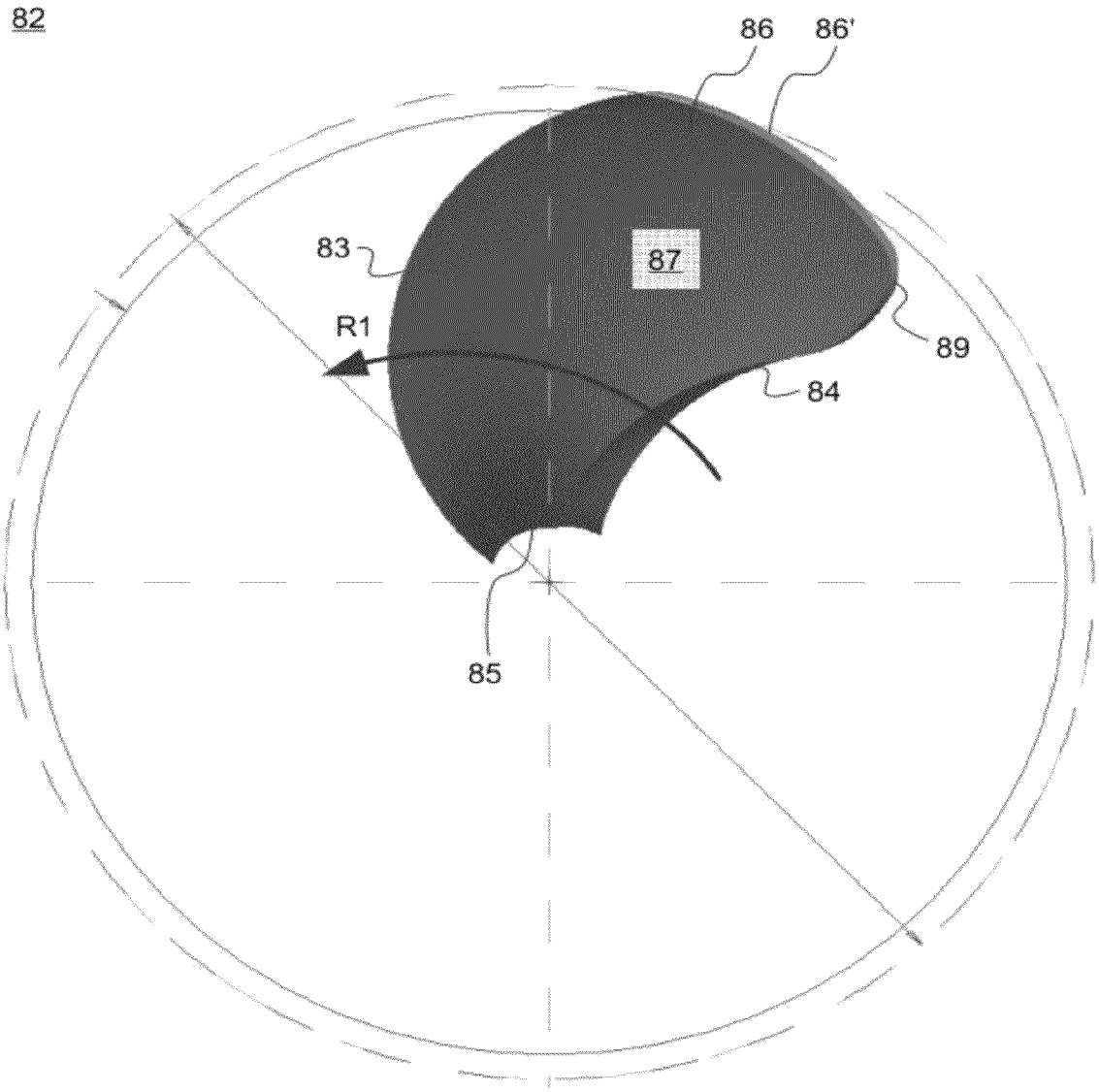
FIG. 10 is a bottom view of the pitch face of a initial blade shape that is trimmed to determine blade shape of the impeller depicted in FIG. 9B.

Referring now to FIG. 10, each blade 82 of the impeller 80 may have an initial tip edge 86' that is initially determined by following the procedure described above with reference to FIGS. 9A and 9B, and then the final tip edge 86 (the top view is shown in FIG. 9B) may be determined by trimming away the radially outermost portion of the blade 82 from the initial tip edge 86'. For example, between 0-10% of the radially outermost portion of the blade 82 may be trimmed away, preferably between approximately 3-7% of the radially outermost portion of the blade 82 may be trimmed away, and, as shown in FIG. 10, most preferably approximately 5% of the radially outermost portion of the blade 82 may be trimmed away.

By trimming away a portion of the radially outermost portion of the blade 82, the projected blade area ratio (PAR) may be increased relative to the initial shape of the blade 82 before trimming of the initial tip edge 86'. As used herein, the projected blade area ratio is the ratio of projected blade area to the entire area swept by the blade. For example, as shown in FIG. 9B, impeller 80 has approximately a 60% blade area ratio, which means that from a top view, the three blades 82 cover a total of 60% of the surface area of the entire area included inside a diameter swept by the tip edge 86 when it completes a single rotation. Therefore, each of the three blades 82 covers approximately 20% of the total top view surface area.

Figure 11A:
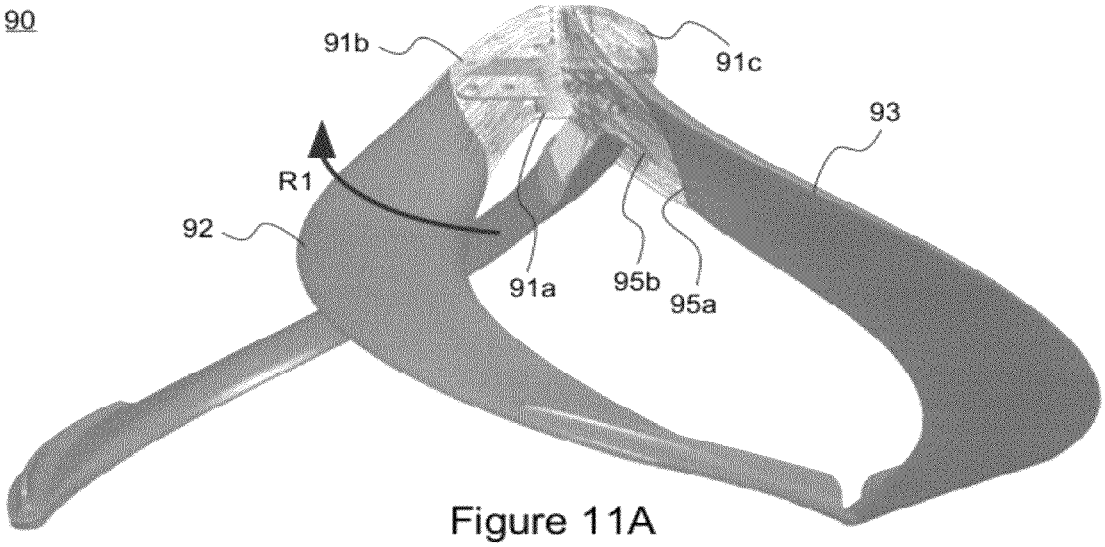
FIG. 11A is a side view of an impeller having a hub shell.
Figure 11B:
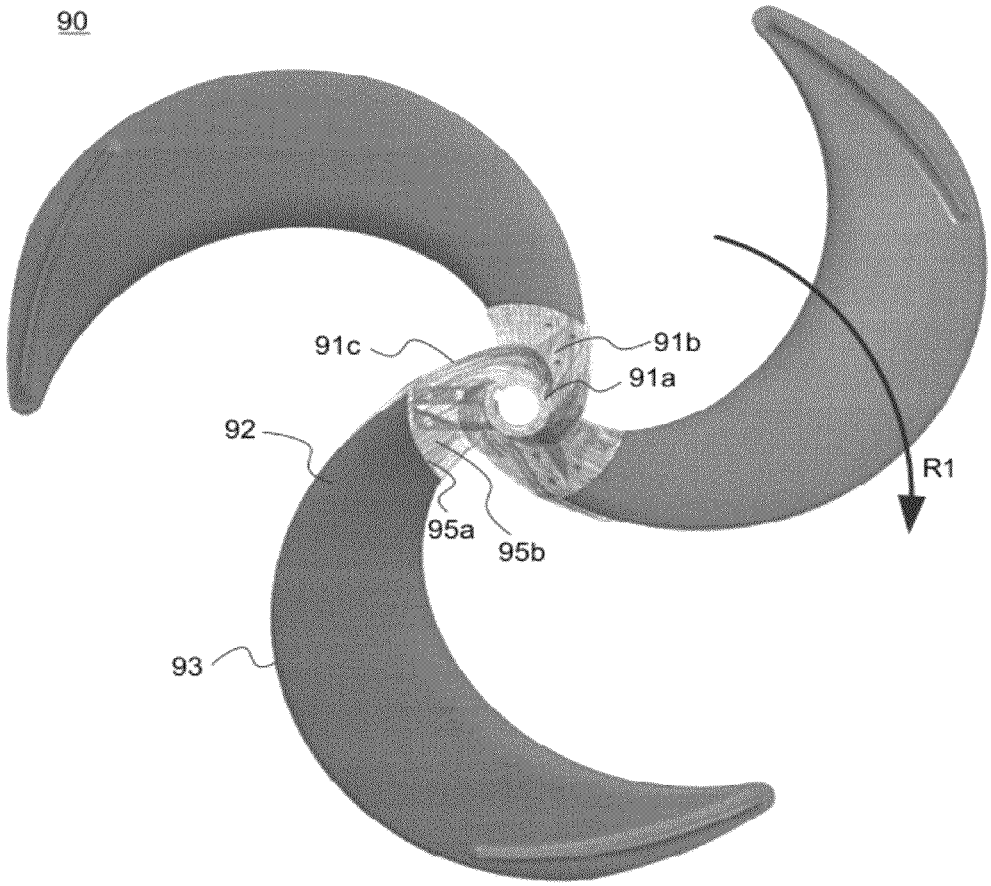
FIG. 11B a top view of the impeller depicted in FIG. 11A.

Referring now to FIGS. 11A and 11B to illustrate another embodiment, an impeller 90 includes a hub 91*a* having plural flanges 91*b* and surrounded by a hub shell 91*c*, and plural blades 92. Impeller 90 preferably rotates about the hub 91*a* in a rotational direction R1. Each blade 92 is spaced circumferentially about the hub 91*a*, and each blade 92 includes a leading edge 93, a root edge 95*a*, a stiffness insert 95*b*, and, for example, the other blade shape features discussed above relating to the plural blades 72 shown in FIGS. 8A and 8B.

The hub shell 91*c* may be made, for example, from a similar material as the blades 92, such as FRP. As shown in the Figures, the hub shell 91*c* may partially or completely surround any or all of the hub 91*a*, the flanges 91*b*, and the stiffness inserts 95*b*, and the hub shell 91*c* may have a substantially smooth, substantially ellipsoidal, aerodynamically streamlined shape in the anticipated direction of the liquid flow. Although the hub shell 91*c* is shown as having an ellipsoidal shape, the hub shell 91*c* may have any shape, including, for example, a sphere, a hemisphere, a torus, an ovoid shape, a paraboloid, or any other shape known in the art that preferably has a smoothly varying slope.

The hub shell 91*c* may partially or completely surround each flange 91*b*, preferably in such a manner as to smoothly extend the surfaces of the blades 92 around and over the hub 91*a*. For example, the hub shell 91*c* may extend the leading edge 93 of each blade 92, with a continuously varying slope, to the center of the hub shell 91*c*. The hub shell 91*c* preferably extends the surfaces of the blades 92 (e.g., the leading edge 93) from the root edges 95*a*, over the stiffness inserts 95*b*, and the hub shell 91*c* preferably merges the extended surfaces of the blades 92 towards the center of the hub 91*a*. The hub shell 91*c* may include a central aperture to accommodate a drive shaft, and the hub shell 91*c* may include additional apertures to allow for the insertion of bolts or other coupling mechanisms to attach the blades 92 to the flanges 91*b*.

In a waste water treatment application of the impeller 90, for example, an anoxic basin application, the liquid to be mixed may contain a significant amount of rags or other continuous string-like or fibrous materials that may become caught on discontinuous-slope portions of the impeller 90. This "ragging" effect may cause undesirable imbalance of the impeller 90 and/or additional drag forces on the impeller 90 during rotation in the direction R1 which can increase the force on the driveshaft motor.

The inventor has noticed that the presence of the hub shell 91*c* in the impeller 90 may make the impeller 90 more resistant to ragging at the discontinuous slope portions of the hub 91*a*, the flanges 91*b*, the root edges 95*a*, and the stiffness inserts 95*b*. The inventor surmises that the continuously varying slope provided by the hub shell 91*c* (in the direction of the anticipated fluid flow) may reduce the amount of drag the impeller 90 may experience during rotation of the impeller in the direction R1.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims. Furthermore, any features of one described embodiment can be applicable to the other embodiments described herein.

What is claimed:

1. An impeller, comprising:

a hub defining a longitudinal axis; and plural blades spaced circumferentially about the hub, each blade including a root portion and a tip portion, each blade defining a leading edge having an approximately circular raked helical geometry, the leading edge defining a top view shape, the top view shape being a circular arc which total extent is between 30 and 180 degrees.

2. The impeller of claim 1, wherein each blade has a variable pitch such that the root portion induces primarily axial fluid flow and the tip induces primarily radially inward fluid flow when the blades are rotated about the longitudinal axis.

3. The impeller of claim 1, wherein each leading edge defines a side view shape, the side view shape being tuned to approximately the same side view shape as the constant velocity fluid boundary on the intake side of the impeller.

4. The impeller of claim 1, wherein each blade includes a pitch face that defines a plurality of camber lines, each camber line having a shape that approximately follows an exponential curve.

5. The impeller of claim 4, wherein the exponential curve for each pitch face camber line is created within a conical helix reference frame normal to the leading edge.

6. The impeller of claim 1, wherein the circular arc is between 120 and 180 degrees.

7. The impeller of claim 1, further comprising a hub shell having a substantially ellipsoidal shape that has a substantially continuously varying slope in the direction of the fluid flow that is induced when the blades are rotated about the longitudinal axis.

8. The impeller of claim 1, wherein the hub has a vertical height and the root portion of each blade has a vertical height, and the vertical height of each root edge is greater than the vertical height of the hub.

9. A system for mixing a fluid, the system comprising:

a tank for containing the fluid;

a drive shaft for extending into the tank; and an impeller, comprising a hub defining a longitudinal axis and plural blades spaced circumferentially about the hub, each blade including a root portion and a tip portion, each blade defining a leading edge having an approximately circular raked helical geometry, the leading edge defining a top view shape, the top view shape being a circular arc which total extent is between 30 and 180 degrees.

10. The system of claim 9, wherein each blade has a variable pitch such that the root portion induces primarily axial fluid flow and the tip induces primarily radially inward fluid flow when the blades are rotated about the longitudinal axis.

11. The system of claim 9, wherein each leading edge defines a side view shape, the side view shape being tuned to approximately the same side view shape as the constant velocity fluid boundary on the intake side of the impeller.

12. The system of claim 9, wherein each blade includes a pitch face that defines a plurality of camber lines, each camber line having a shape that approximately follows an exponential curve.

13. The system of claim 12, wherein the exponential curve for each pitch face camber line is created within a conical helix reference frame normal to the leading edge.

14. The system of claim 9, wherein each leading edge defines a top view shape, the top view shape being a circular arc of between 120 and 180 degrees.

15. The system of claim 9, further comprising a hub shell having a substantially ellipsoidal shape that has a substantially continuously varying slope in the direction of the fluid flow that is induced when the blades are rotated about the longitudinal axis.

16. The impeller of claim 9, wherein the hub has a vertical height and the root portion of each blade has a vertical height, and the vertical height of each root edge is greater than the vertical height of the hub.

17. The impeller of claim 1 wherein the circular rake angle varies from the leading to the trailing edge along a given cylindrical cut where the central axis of the cylindrical cut is coincident with the propeller axis of rotation.

18. The system of claim 9 wherein the circular rake angle varies from the leading to the trailing edge along a given cylindrical cut where the central axis of the cylindrical cut is coincident with the propeller axis of rotation.

19. The impeller of claim 1 further comprising a blade tip zone that extends the impeller tip and is configured to produce radial flow.

20. The system of claim 9 further comprising a blade tip zone that extends the impeller tip and is configured to produce radial flow.

21. The impeller of claim 1 wherein the approximately circular raked helical geometry of the leading edges approximately conforms to a constant velocity profile of fluid on an inlet side of the impeller.

22. The system of claim 9 wherein the approximately circular raked helical geometry of the leading edges approximately conforms to a constant velocity profile of fluid on an inlet side of the impeller.

23. The impeller of claim 1 wherein each blade defines a root edge and the impeller further comprises a hub having a smaller vertical height than the vertical height of the root.

24. The system of claim 9 wherein each blade defines a root edge and the impeller further comprises a hub having a smaller vertical height than the vertical height of the root.

25. The impeller of claim 23 wherein a portion of the root edge extends below the bottom of the hub.

26. The system of claim 24 wherein a portion of the root edge extends below the bottom of the hub.

* * * * *